United States Patent [19]

Tanji et al.

[11] Patent Number: 5,077,188

[45] Date of Patent: Dec. 31, 1991

[54] SILVER HALIDE PHOTOGRAPHIC LIGHT-SENSITIVE MATERIAL

[75] Inventors: Masaki Tanji; Toyoki Nishijima, both of Odawara; Hirokazu Sato; Tomomi Yoshizawa, both of Tokyo, all of Japan

[73] Assignee: Konica Corporation, Tokyo, Japan

[21] Appl. No.: 473,340

[22] Filed: Feb. 1, 1990

[30] Foreign Application Priority Data

| | | | |
|---|---|---|---|
| Feb. 6, 1989 | [JP] | Japan | 1-26954 |
| Feb. 15, 1989 | [JP] | Japan | 1-36573 |
| Mar. 24, 1989 | [JP] | Japan | 1-73005 |

[51] Int. Cl.[5] ..... G03C 7/26

[52] U.S. Cl. ..... 430/546; 430/552; 430/553; 430/567

[58] Field of Search ..... 430/546, 552, 553, 567

[56] References Cited

U.S. PATENT DOCUMENTS

| | | | |
|---|---|---|---|
| 3,619,195 | 11/1971 | Van Campen | 430/545 |
| 4,731,320 | 3/1988 | Sasaki et al. | 430/546 |
| 4,820,614 | 4/1989 | Takada et al. | 430/505 |
| 4,822,728 | 4/1989 | Loialono et al. | 430/503 |
| 4,857,449 | 8/1989 | Ogawa et al. | 430/546 |

FOREIGN PATENT DOCUMENTS

| | | | |
|---|---|---|---|
| 0256531 | 2/1988 | European Pat. Off. | 430/545 |
| 0276319 | 3/1988 | European Pat. Off. . | |
| 0320821 | 6/1989 | European Pat. Off. . | |
| 0353714 | 2/1990 | European Pat. Off. . | |

*Primary Examiner*—Charles L. Bowers, Jr.
*Assistant Examiner*—Thorl Chen
*Attorney, Agent, or Firm*—Frishauf, Holtz, Goodman & Woodward

[57] ABSTRACT

A silver halide photographic light-sensitive material is disclosed, which is improved in stability of cyan dye image formed therein. The light-sensitive material comprises a support having thereon a silver halide emulsion layer containing oleophilic dispersed particles. The particles comprises a cyan coupler represented by the following Formula I, an organic solvent selected from phthalic esters having a dielectrical constant of not more than 6.0 and a polymer compounds which is insoluble in water and soluble in a organic solvent:

(I)

wherein $R_1$ is a ballast group, $R_2$ is an alkyl group having 2 or more carbon atoms and $Z_1$ is a hydrogen atom or a substituent capable of splitting off upon reaction with the oxidation product of a color developing agent.

18 Claims, No Drawings

SILVER HALIDE PHOTOGRAPHIC LIGHT-SENSITIVE MATERIAL

FIELD OF THE INVENTION

The present invention relates to a silver halide photographic light-sensitive material, particularly to a silver halide photographic light-sensitive material remarkably improved in the color forming efficiency preservability of cyan dye image and in the balance of color fading.

BACKGROUND OF THE INVENTION

In the subtractive color photography system used normally in the field of photographic technology for obtaining color images, aromatic primary amine type color developing agent, hereunder, it is simply called color developing agent, is used for developing silver halide grains after image-wise exposure, as is known very well. Through a reaction between the oxidized product of the color developing agent generated by the development of the silver halide grain and a coupler of a certain type, yellow, magenta or cyan dye images can be formed.

The dye images thus obtained are required not to change and fade colors even when they are exposed to light for a long time or preserved under the condition of high temperature and high humidity. However, the lightfastness of actual dye images to ultra-violet rays or visible light is not satisfactory, besides, preservability in dark place is not sufficient. Therefore, the improvement of image preservability under various conditions has been an endless theme in the research and development field.

With regard to the improvement of such image preservability, various studies such as the improvement of the image preservability of dye formed from coupler itself and the development of image stabilizer have been made.

Among them, conventional phenol type cyan coupler having an alkyl group at its fifth position which are used widely as a cyan coupler, have a certain level of lightfastness, but it is not satisfactory. Moreover, such type cyan couplers have a problem that they are considerably poor in dark preservability. As a cyan coupler which has improved in its dark preservability, 2,5-diacylaminophenol type cyan coupler is known, for example, it is disclosed in U.S. Pat. No. 2,895,826, Japanese Patent Publication Open to Public Inspection, hereinafter referred to as Japanese Patent O.P.I. Publication, Nos. 112038/1975, 109630/1978 and 163537/1980. However, the lightfastness of the dye image obtained from 2,5-diacylaminophenol type cyan coupler has been deteriorated in many cases, though the dark preservability thereof has been improved remarkably.

In order to solve such problems, methods in which the above-mentioned two couplers are used in combination are disclosed in many patent publication including Japanese Patent O.P.I. Publication No. 100440/1984. However, it has naturally been difficult to cover the weak points of each coupler. Therefore, further basic improvement has been necessary for the couplers.

On the other hand, various attempts have been made to cause both image stabilizer and cyan coupler to exist together and thereby to improve the image preservability. Methods to use U V absorbing agent and various stabilizers are disclosed in Japanese Patent Examined Publication Nos. 31256/1973 and 31625/1973, U.S. Pat. Nos.3,069,262, 3,432,300 and 3,574,627 and Japanese Patent O.P.I. Publication Nos. 221844/1983, 124340/1984, 232649/1987 and 178258/1987, but, all of them are insufficient in terms of their effect.

Recently, there have been studied the methods to improve image preservability by using specific materials as media as for dispersing the coupler. For example, they have been opened in Japanese Patent O.P.I. Publication Nos. 129853/1987, 178259/1987, 44658/1988 and 250648/1988 and No. 20545/1987. In many cases, however, color forming efficiency is deteriorated remarkably. With regard to image preservability, lightfastness or dark preservability is improved but other factors are not improved or deteriorated remarkably.

The image preservability of magenta dye image wherein the color balance in time of fading was rate-determined has been increased by the development of various anti-fading agent recently. Therefore, in order to maintain the color balance in time of fading, it has become necessary to further improve the preservability of cyan dye image.

SUMMARY OF THE INVENTION

The object of the present invention is to provide a silver halide photographic light-sensitive material wherein the image preservability of the cyan dye image is improved without deteriorating other photographic characteristics.

The object of the invention is accomplished by a silver halide photographic light-sensitive material comprising a support having thereon a silver halide emulsion layer containing oleophilic dispersed particles comprising a cyan coupler represented by the following Formula I, a high-boiling organic solvent selected from the group consisting of phthalic esters having a dielectric constant of not more than 6.0, and a polymer compounds being insoluble in water and soluble in an organic solvent:

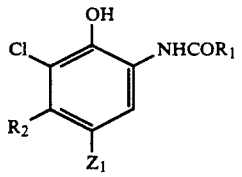

Formula I

Wherein $R_1$ is a ballast group, $R_2$ is an alkyl group having 2 or more carbon atoms and $Z_1$ is a hydrogen atom or a substituent capable of splitting off upon reaction with the oxidation product of a color developing agent.

As the polymer compound, a polymer and copolymer of vinyl monomer, a polyester resin produced by condensation polymerization of a polyhydric alcohol and a polybasic acid and a polyseter resin produced by ring-opening polymerization are preferably used.

It is particularly preferable to use a cyan coupler represented by the following Formula II together with the cyan coupler represented by Formula I:

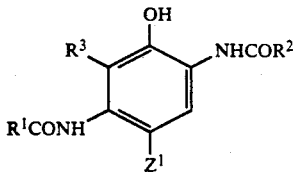

Formula II wherein $R_1$ is an alkyl group or an aryl group, $R^2$ is an alkyl group, a cycloalkyl group, an aryl group or a heterocyclic group, $R^3$ is a hydrogen atom, a halogen atom, an alkyl group or an alkoxy group, provided that the group represented by $R^3$ is allowed to form a ring together with the group represented by $R^1$, $Z^1$ is a hydrogen atom or a substituent capable of splitting off upon reaction with the oxidation product of a color developing agent.

DETAILED DESCRIPTION OF THE INVENTION

In cyan coupler represented by the above formula I, an alkyl group represented by $R_2$ may have a straight chain or a branched chain, also includes one having a substituent.

$R^2$ is preferably an alkyl group having 2 through 6 number of carbon atoms.

A ballast group represented by $R_1$ is an organic group having such a size and form as giving enough bulk so that the coupler is not diffused substantially to other layers from the layer to which the coupler is applied.

As a ballast group, what is preferable is represented by the following formula I-B.

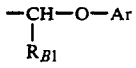

Formula I-B $R_{B1}$ is an alkyl group having 1 to 12 carbon atoms. Ar is an aryl group such as a phenyl group. This aryl group includes one having a substituent.

As below, the concrete examples of couplers represented by the formula I are indicated. But the invention is not limited to them.

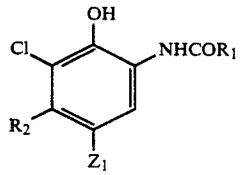

| Coupler No. | $R_2$ | $Z_1$ | $R_1$ |
|---|---|---|---|
| I-1 | $-C_2H_5$ | $-Cl$ | 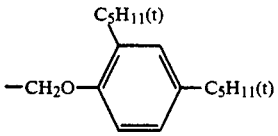 |
| I-2 | $-C_2H_5$ | 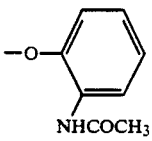 | 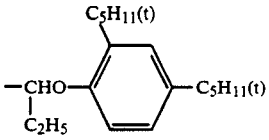 |
| I-3 | $-C_3H_7(i)$ | $-Cl$ | 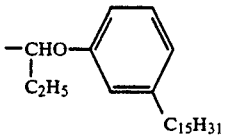 |
| I-4 | $-C_2H_5$ | $-Cl$ | 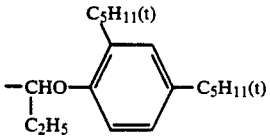 |
| I-5 | $-C_4H_9$ | $-F$ | 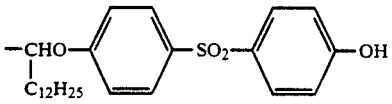 |

-continued
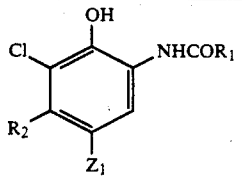
| Coupler No. | $R_2$ | | $R_1$ |
|---|---|---|---|
| I-6 | $-C_2H_5$ | $-F$ | 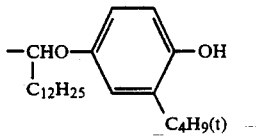 |
| I-7 | $-C_2H_5$ | $-Cl$ | 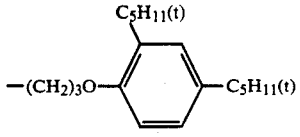 |
| I-8 | $-C_2H_5$ | $-Cl$ | 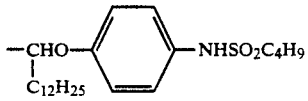 |
| I-9 | $-C_2H_5$ | $-Cl$ | 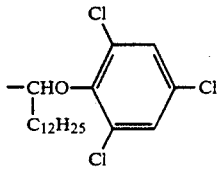 |
| I-10 | $-C_2H_5$ | $-Cl$ | $-C_{15}H_{31}$ |
| I-11 | $-C_6H_{13}$ | $-Cl$ | 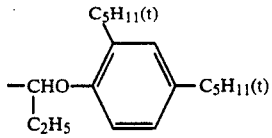 |
| I-12 | $-C_3H_7$ | $-Cl$ | 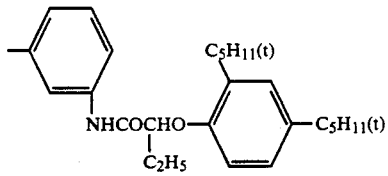 |
| I-13 | $-(CH_2)_2NHCOCH_3$ | $-Cl$ | 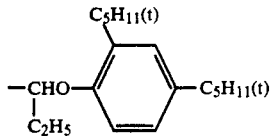 |
| I-14 | $-(CH_2)_2OCH_3$ | $-Cl$ | 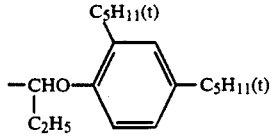 |
| I-15 | $-C_2H_5$ | $-Cl$ | 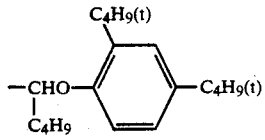 |

-continued

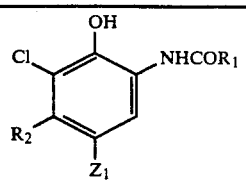

| Coupler No. | $R_2$ | | $R_1$ |
|---|---|---|---|
| I-16 | $-C_4H_9(t)$ | $-O(CH_2)_2-SO_2CH_3$ | 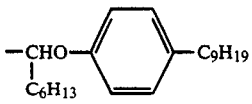 |
| I-17 | $-C_2H_5$ | $-Cl$ | 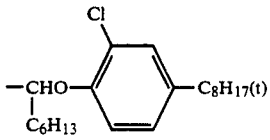 |
| I-18 | $-C_2H_5$ | $Z^2$ $-Cl$ | 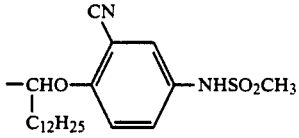 |
| I-19 | $-C_2H_5$ | $-Cl$ | 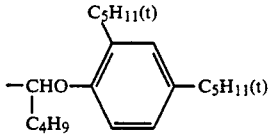 |
| I-20 | $-C_2H_5$ | $-Cl$ | $-C_{15}H_{31}$ |

Including them, examples of cyan couplers which can be used in the present invention are described in Japanese Patent Examined Publication No. 11572/1974, Japanese Patent O.P.I. Publication Nos. 3142/1986, 9652/1986, 9653/1986, 39045/1986, 50136/1986, 99141/1986 and 105545/1986.

Cyan dye forming coupler represented by the above-mentioned formula I in the present invention can be used in the range of $1\times10^{-3}$ to 1 mol per mol of silver halide, more preferably $1\times10^{-2}$ to $8\times10^{-1}$ mol per mol of silver halide contained in the emulsion layer in which the cyan coupler to be added.

In the light-sensitive material of the invention, it is particularly preferable to use a cyan coupler represented by the following Formula II together with the above-mentioned cyan coupler represented by Formula I. Dark preservability of cyan image is further improved by using these two types of couplers without deterioration of color of the cyan image.

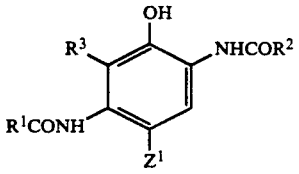

Formula II

Wherein, $R^1$ is an alkyl group or an aryl group. $R^2$ is an alkyl group, a cycloalkyl group, an aryl group or a heterocyclic group. $R^3$ is a hydrogen atom, a halogen atom, an alkyl group or an alkoxy group. $R^3$ is allowed to form ring with $R^1$. $Z^1$ is a hydrogen atom or a substituent capable of splitting of upon reaction with the oxidation product of a color developing agent.

In the cyan coupler represented by the above-mentioned Formula II, as alkyl group represented by $R^1$, those having 1 to 32 carbons are preferable. They can be straight chain or branched, and including those having substituent group.

As an aryl group represented by $R^1$, phenyl group is preferable, and it which includes one having a substituent.

As an alkyl group represented by $R^2$, those having 1 to 32 of carbon. These alkyl group can be either straight chain or branched, also can contain a substituent.

As a cycloalkyl group represented by $R^2$, those having 3 to 12 carbons are repreferable. These cycloalkyl group can contain a substituent.

As an aryl group represented by $R^2$, phenyl group is preferable, and it includes those having a substituent.

As a heterocyclic group represented by $R^2$, those having 5 to 7 members are preferable. They can contain those having a substituent those condensed with another ring.

$R^3$ is a hydrogen atom, a halogen atom, an alkyl group or an alkoxy group. The alkyl group and alkoxy group contain those having a substituent. $R^3$ is preferably a hydrogen atom.

Besides, as a ring formed by Combining $R^1$ and $R^3$ to form a ring having 5 to 6 members such as the following example are preferable.

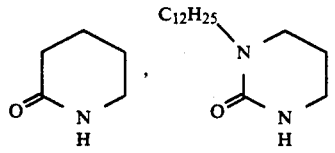

As a substituent represented by $Z^1$ in Formula I, a halogen atom, an alkoxy group, an aryloxy group, an acyloxy group, a sulfonyloxy group, an acylamino group, a sulfonylamino group, an alkoxycarbonyloxy group, an aryloxycarbonyloxy group and an imido group, all of them include those having a substituent group, are receided but the preferable is a halogen atom, an aryloxy group and an alkoxy group.

Among the above-mentioned cyan coupler, particularly preferable is given as the following formula II-A.

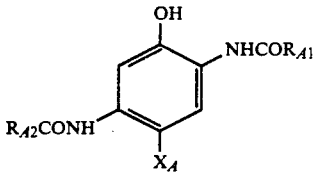

Formula II-A

Wherein, $R_{A1}$ is a phenyl group substituted by at least one halogen atom, which is allowed to have a substituent other than the halogen atom. $R_{A2}$ is same as $R^1$ of the above-mentioned Formula II. $X_A$ is a halogen atom, an aryloxy group or an alkoxy group, which may include those having a substituent. Hereunder, typical example of cyan couplers represented by Formula II will be given.

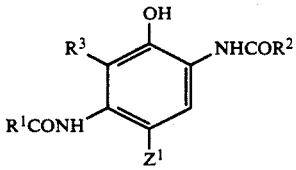

| Illustrated Compound No. | $R^2$ | $R^1$ | $R^3$ | $Z^1$ |
|---|---|---|---|---|
| II-1 | $-(CF_2)_4H$ | 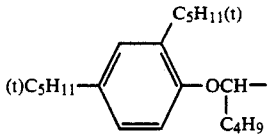 | H | —Cl |
| II-2 | 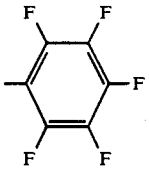 | 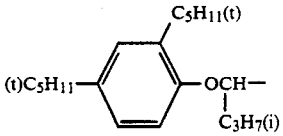 | H | —Cl |
| II-3 | 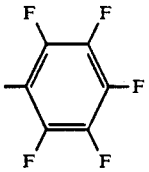 | 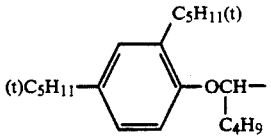 | H | —Cl |
| II-4 | 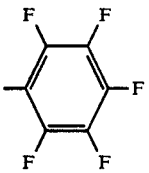 | $C_{16}H_{33}$— | —Cl | —Cl |
| II-5 | 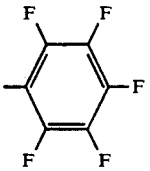 | 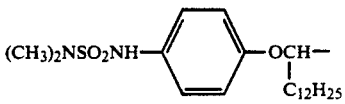 | H | 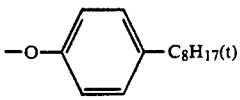 |

-continued
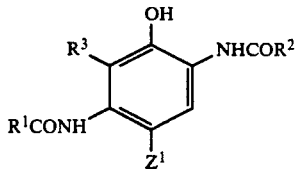
| Illustrated Compound No. | $R^2$ | $R^1$ | $R^3$ | $Z^1$ |
|---|---|---|---|---|
| II-6 | 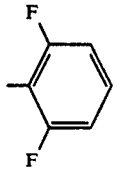 | 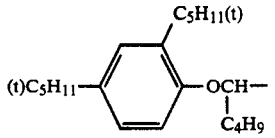 | H | H |
| II-7 | 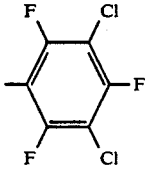 | 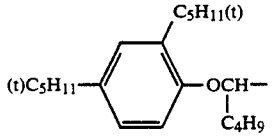 | H | —Cl |
| II-8 | 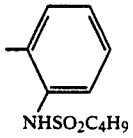 | 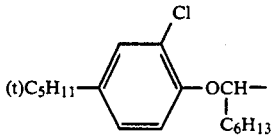 | H | —Cl |
| II-9 | 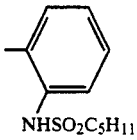 | 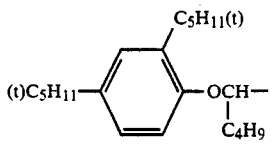 | H | 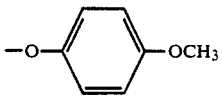 |
| II-10 | 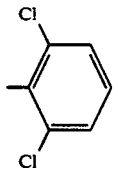 | 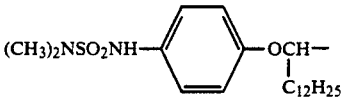 | H | —Cl |
| II-11 | 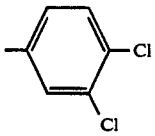 | 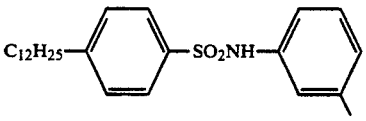 | H | —Cl |
| II-12 | 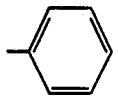 | 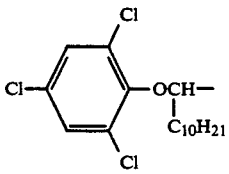 | H | $-OCH_2CONHC_3H_7$ |
| II-13 | 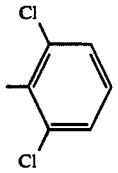 | 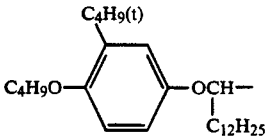 | H | —Cl |

-continued
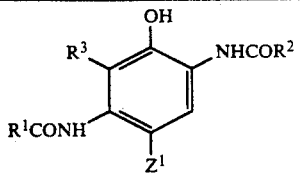
| Illustrated Compound No. | $R^2$ | $R^1$ | $R^3$ | $Z^1$ |
|---|---|---|---|---|
| II-14 | 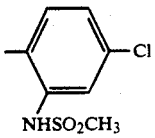 | 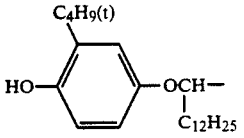 | H | —Cl |
| II-15 | 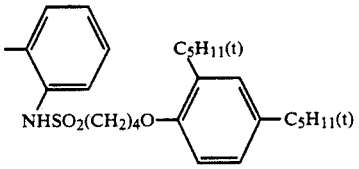 | 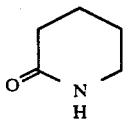 | | —Cl |
| II-16 | 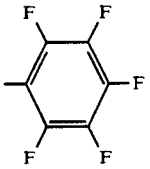 | 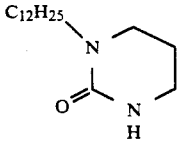 | | —Cl |
| II-17 | 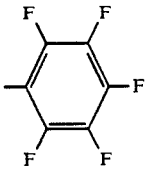 | 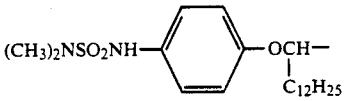 | H | —Cl |
| II-18 | 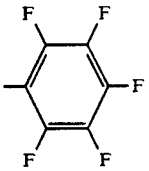 | 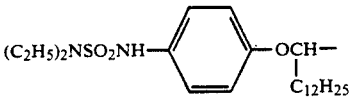 | H | —Cl |
| II-19 | 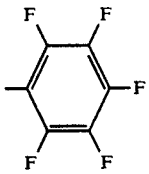 | 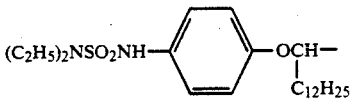 | H | 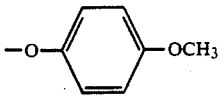 |
| II-20 | 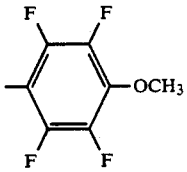 | 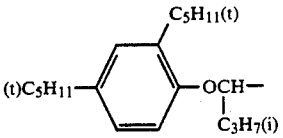 | H | —Cl |
| II-21 | 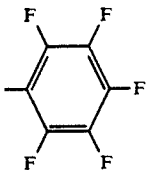 | 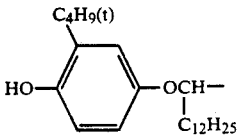 | H | —Cl |

-continued
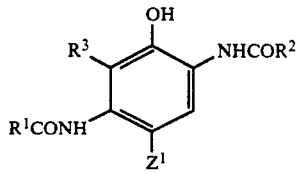
| Illustrated Compound No. | $R^2$ | $R^1$ | $R^3$ | $Z^1$ |
|---|---|---|---|---|
| II-22 | 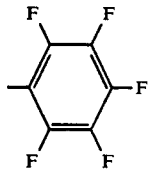 | 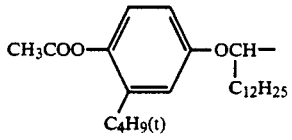 | H | —Cl |
| II-23 | 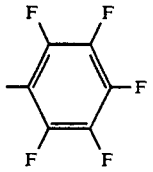 | 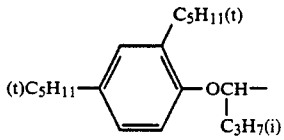 | H | 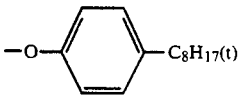 |
| II-24 | 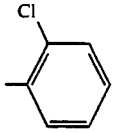 | 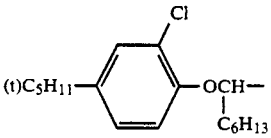 | H | —Cl |
| II-25 | 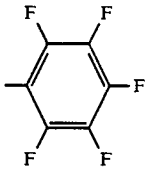 | 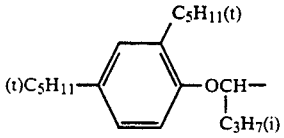 | H | $-OCH_2CONH(CH_2)_2OCH_3$ |
| II-26 | 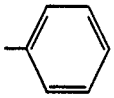 | 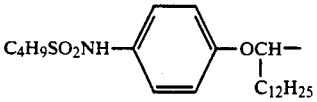 | H | —Cl |
| II-27 | $-C_3F_7$ | 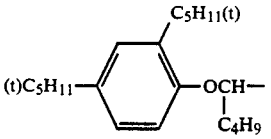 | H | H |
| II-28 | $-C_3F_7$ | 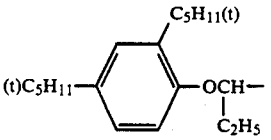 | H | H |
| II-29 | 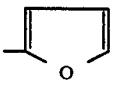 | 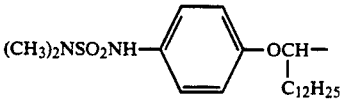 | H | Cl |
| II-30 | 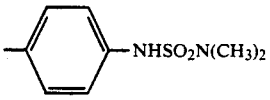 | 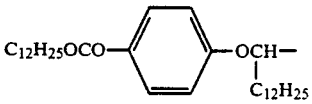 | $CH_3O$ | Cl |

-continued

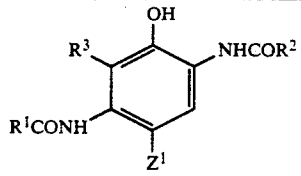

| Illustrated Compound No. | $R^2$ | $R^1$ | $R^3$ | $Z^1$ |
|---|---|---|---|---|
| II-31 | 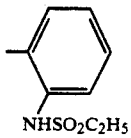 | 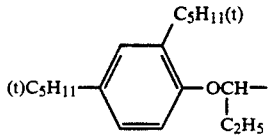 | H | Cl |

Besides, as examples of the above-mentioned cyan coupler, for example, such 2, 5 - diacylamino type cyan couplers as are indicated in A-16 through A-50 described in Japanese Patent O.P.I. Publication No. 178962/1987 from the right upper column of page 7 to the left lower column of page 9, those in Japanese Patent O.P.I. Publication No. 225155/1985 from the left lower column of page 7 to the right lower column of page 10, those in Japanese Patent O.P.I. Publication No. 222853/1985 from the left upper column of page 6 to the right lower column of page 8 and those in Japanese Patent O.P.I. Publication No. 185335/1984 from the left lower column of page 6 to the left upper column of page 9. They can be synthesized according to the methods described in these Publications.

A preferable adding amount of the cyan coupler represented by the Formula II is within the range of from $2\times10^{-3}$ to $8\times10^{-1}$ mols, and especially preferable from $1\times10^{-2}$ to $5\times10^{-1}$ mols per mol of silver halide.

High boiling organic solvent used with cyan coupler in the present invention is a phthalic acid ester having a dielectric constant of not more than 6.0. More preferable ones are those having a dielectric constant of not more than 5.0 and not less than 1.9, and the vapor pressure of not more than 0.5mmHg at 100° C. The high boiling organic solvent may be a mixture of two or more kinds.

The above-mentioned dielectric constant is that at 30° C., and the high boiling means a boiling point of not less than 150° C. under 1 atm.

A phthalic acid ester preferably used in the present invention, for example are those represented by the following formula.

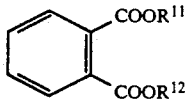

Formula S

In the formula, $R^{11}$ and $R^{12}$ are each an alkyl group and an alkenyl group or aryl group. Total number of carbon atoms contained in the groups represented by $R^{11}$ and $R^{12}$ is 12 to 32. Preferable total number of carbon atoms is 16 to 24, and more preferably 18 to 24.

In the present invention, an alkyl group represented by $R^{11}$ and $R^{12}$ in the above-mentioned formula S may be a straight chain or a branched chain such as a butyl group, a pentyl group, a hexyl group, a 2-ethylhexyl group, a 3,5,5-trimethylhexyl group, an octyl group, a nonyl group, a decyl group, a dodecyl group, a tetradecyl group, a hexadecyl group and an octadecyl group.

Aryl groups represented by $R^{11}$ and $R^{12}$ are, for example, a phenyl group and a naphtyl group, and alkenyl groups are, for example, a hexenyl group, a heptenyl group and an octadecenyl group.

These alkyl group, alkenyl group and aryl group include those having one or plural substituents. A substituent of the alkyl group and alkenyl group are, for example a halogen atom, an alcoxy group, an aryl group, an aryloxy group, an alkenyl group and an alcoxycarbonyl group. A substituent of the aryl group are, for example, a halogen atom, an alkyl group, an alcoxy group, an aryl group, an aryloxy group, an alkenyl group and an alcoxycarbonyl group.

In the foregoing, $R^{11}$ and $R^{12}$ are each preferably an alkyl group, for example, a 2-ethylhexyl group, a 3,5,5-trimethylhexyl group, an n-octyl group and an n-nonyl group.

Hereunder, typical examples of high boiling organic solvent preferably used in the present invention are illustrated, but the present invention is not limited to them.

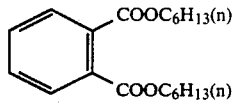

S-1

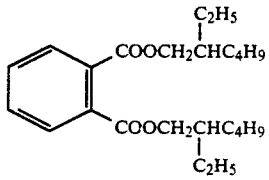

S-2

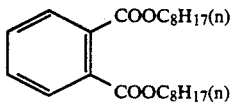

S-3

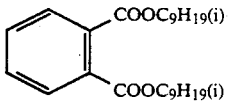

S-4

-continued

S-5

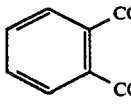

S-6

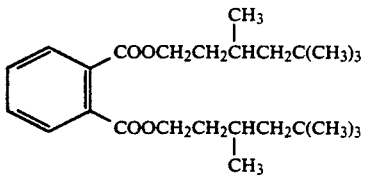

S-7

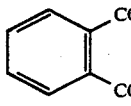

S-8

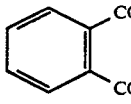

S-9

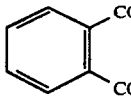

S-10

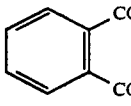

S-11

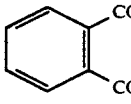

The amount of high boiling point organic solvent to be used in the present invention is preferable to be 0.1 to 10 ml per 1 g of cyan coupler of the present invention, and more preferable to be 0.1 to 5 ml.

Within the range where the effect of the present invention is not damaged, organic solvents other than those used in the present invention can be used in combination.

Then, the polymer compound, hereafter, it is called polymer and copolymer relating to the present invention will be detailed.

(1) Vinyl polymer and copolymer

With regard to monomers capable of forming a vinyl copolymer or copolymer, more practically, as acrylic acid esters, methyl acrylate, ethyl acrylate, isopropyl acrylate, butyl acrylate, t-butyl acrylate, amyl acrylate, hexyl acrylate, 2-ethylhexyl acrylate, t-octyl acrylate, 2-chloroethyl acrylate, 4-chlorobutyl acrylate, cyanoethyl acrylate, 2-acetoxyethyl acrylate, dimethylaminoethyl acrylate, methoxybenzyl acrylate, cyclohexyl acrylate, tetrahydrofurfulyl acrylate, phenyl acrylate, 2,2-dimethyl-3-hydroxypropyl acrylate, 2-methoxyethyl acrylate, 2-ethoxyethyl acrylate, 2-i-propoxy acrylate, 2-(2-methoxyethoxy)ethyl acrylate, ω-methoxypolyethylenegrycol acrylate (number of polymerized ethylenglycol units n =9), 1-bromo-2-methoxyethyl acrylate may be cited.

As examples of methacrylic acid esters, methyl methacrylate, ethyl methacrylate, propyl methacrylate, butyl methacrylate, isobutyl methacrylate, amyl methacrylate, cyclohexyl methacrylate, benzyl methacrylate, octyl methacrylate, sulfopropyl methacrylate, N-ethyl-N-phenylaminoethyl methacrylate, dimethylaminophenoxyethyl methacrylate, furflyl methacrylate, phenyl methacrylate, cresyl methacrylate, naphthyl methacrylate, 2-hydroxyethyl methacrylate, triethylene glycol monomethacrylate, 2-methoxyethyl methacrylate, 2-acetoxyethyl methacrylate, 2-ethoxyethyl methacrylate, 2-(2-methoxyethoxy)ethyl methacrylate, ω-methoxypolyethyleneglycol methacrylate (number of polymerized ethylenglycol units n=6) may be cited.

As examples of vinyl esters, vinyl acetate, vinyl propionate, vinyl butylate, vinyl isobutylate, vinyl caproate, vinyl chloroacetate, vinyl methoxyacetate, vinyl phenylacetate, vinyl benzoate and vinyl salicylate may be cited.

As examples of acrylamides, acrylamides, ethylacrylamide, propylacrylamide, butylacrylamide, t-butylacrylamide, cyclohexylacrylamide, benzylacrylamide, hydroxymethylacrylamide, methoxyethylacrylamide, dimethylaminoethylacrylamide, phenylacrylamide, dimethylacrylamide, β-cyanoethylacrylamide, N-(2-acetoacetoxyethyl)acrylamide, diacetonacrylamide, N-(4-hydroxyphenyl)acrylamide, N-[4-(4'-hydroxyphenylsulfonyl)phenyl]acrylamide and N-(2-hydroxy-5-ethylsulfonylphenyl)acrylamide are cited.

As examples of methacrylamides, methacrylamide, methylmethacrylamide, ethylmethacrylamide, propylmethacrylamide, butylmethacrylamide, t-butylmethacrylamide, cyclohexylmethacrylamide, benzylmethacrylamide, hydroxymethylmethacrylamide, methoxyethylmethacrylamide, dimethylaminoethylmethacrylamide, phenylmethacrylamide, dimethylmethacrylamide, β-cyanoethylmethacrylamide, N-(2-acetoacetoxyethyl)methacrylamide, N-(3-hydroxyphenyl)methacrylamide, N-(2-hydroxy-5-chlorophenyl)methacrylamide may be cited.

Besides, as examples of olefins, dicyclopentadiene, ethylene, propyrene, 1-butens, 1-pentene, vinyl chloride, vinylidene chloride, isoprene, chloroprene, butadiene and 2,3-dimethylbutadiene are cited.

As examples of styrenes, styrene, methylstyrene, tremethystyrene, ethylstyrene, chlormethylstyrene, methoxystyrene, chlorstyrene, dichlorstyrene, methyl benzoate p-hydroxystyrene, m-hydroxystyrene, 3-[4-(4'-hydroxyphenylsulfonyl)phenoxymethyl]styrene may be cited.

As examples of crotonic acid esters, butyl acrotonate and hexyl crotonate are cited.

Besides, as itaconic acid diesters, for example, dimethyl itaconate, diethyl itaconate and dibutyl itaconate are cited.

As maleic acid diesters, for example, diethyl maleate, dimethyl maleate and dibutyl maleate are cited.

As fumaric acid diesters, for example, diethyl fumarate, dimethyl fumarate and dibutyl fumarate are cited.

As examples of the other monomers, the following compounds are cited.

Aryl compounds including, for example, aryl acetate, aryl caprroate, aryl laurate and aryl benzoate;

Vinyl ethers including, for example, methyl vinylether, butylvinylether, methoxyethylvinylether and dimethylaminoethylvinylether;

Vinyl ketones including, for example, methylvinylketone, phenylvinylketone and methoxyethylvinylketone;

Vinyl heterocyclic compounds including, for example, vinylpyrizine, N-vinylimidazole, N-vinyloxazolidone, N-vinyltriazole and N-vinylpyrolidone;

Glycidyl esters including, for example, glycidyl acrylate and glycidylmethacrylate; and Unsaturated nitriles including, for example, acrylonitrile, methacrylonitrile.

Polymers used in the present invention can be homopolymers and co-polymers comprising of the above-mentioned monomers. Besides, according to the necessity, they can also be copolymer composed of two or more kinds of monomers. Copolymers used in the present invention are permitted contain the following monomers having an acid group which is not on the so that the copolymers may not be water-soluble. Accordingly, it is allowed to contain monomers of not more than 20%, further, it is especially preferred not to contain it at all.

Acrylic acid, methacrylic acid, itaconic acid, maleic acid, monoalkyl itaconate, monoalkyl maleate, citraconic acid, stylenesulfonic acid, vinylbenzylsulfonic acid, acryloyloxyalkylsulfonic acid, methacryloyloxyalkylsulfonic acid, acrylamidoalkylsulfonic acid, methacrylamidoalkylsulfonic acid, acryloyloxyalkylphosphate, methacryloyloxyalkylphosphate are cited as the monomers having acid group. These acids may also be alkali metals, for example, Na, K or ammonium salt.

As monomers for forming copolymers used in the present invention, those of the acrylate type, methacrylate type, acrylamide type and methacrylate type are preferable.

Polymers formed by the above-mentioned monomer can be prepared by the solution polymerization method, the balk polymerization method, the suspension polymerization method or the latex polymerization method. As an initiator for such polymerization, water-soluble polymerization initiator and oleophilic polymerization initiator are used As a water-soluble polymerization initiator, for example, persulfates such as potassium persulfate, ammonium persulfate and sodium persulfate, water-soluble azo compounds such as sodium 4,4'-azobis-4-cyano valerate, 2,2'-azo-bis(2-amidinopropane)hydrochloride and hydrogen peroxide can be used. As oleophilic polymerization initiator, for example, oleophilic azo compounds such as azobisisobutylonitryl, 2,2'-azo-bis-2,4-dimethylvaleronitrile), 1,1'-azo-bis(cyclohexanone-1-carbonitrile), dimethyl 2,2'-azo-bisisobutyrate acid and dimethyl 2,2'-azo-bisiso butyrate, benzoyl peroxide, lauryl peroxide, diisopropyl peroxydicarbonate and di-t-butyl peroxide can be cited. (2) Polyester resins produced by condensing a polyhydric alcohol with a polybasic acid.

As polyhydric alcohol, glycols having a structure of $HO—R_1—OH$, in which $R_1$ is a hydrocarbon chain having 2 to 12 carbon atoms, especially aliphatic hydrocarbon, or polyalkylene glycols are effectively used, and as polybasic acids, those having a structure of $HOOC—R_2—COOH$, in which is $R_2$ a simple bonding or a hydrocarbon chain having 1 to 12 carbon atoms, are effectively used.

As examples of polyhydric alcohols, ethylene glycol, diethylene glycol, 1,2-propylene glycol, 1,3-propylene glycol, trimethylol propane, 1,4-butandiol, isobutylenediol, 1,5-pentandiol, neopentyl glycol, 1,6-hexanediol, 1,8-octanediol, 1,9-nonanediol, 1,10-decanediol, glycerol, diglycerol, triglycerol, 1-methylglycerol, erythritol, mannitol and sorbitol are cited.

As examples of poly-basic acids, oxalic acid, succinic acid, glutaric acid, adipic acid, pimelic acid, cork acid, azelaic acid, sebacic acid, decandicarbonic acid, dodecandicarbonic acid, fumaric acid, maleic acid, itaconic acid, citraconic acid, phthalic acid, isophthalic acid, terephthalic acid, tetrachlorophthalic acid, methaconic acid, isopimelic acid, cyclopentadiene - maleic anhydride addition product, rosin - maleic anhydride addition product are cited.

(3) Polyesters produced by the ring-opening polymerization

These polyesters can be prepared, for example, by $\beta$-propiolactone, $\epsilon$-caprolactone and dimethylpropiolactone.

(4) Other polymers

These polymers include polycarbonate resins prepared by condensing glycol or divalent phenol with carbonate or phosgene, polyurethane resins prepared by addition polymerizing polyhydric alcohol and polyvalent isocyanate and polyamide resins prepared from polyvalent amines and polybasic acid.

Number-average molecular weight of a polymer used in the present invention is not limited, but it is preferable to be not more than 200,000, and more preferable to be 5,000 to 100,000.

The ratio by weight of polymer of the present invention to coupler is preferable to be from 1:20 to 20:1, and more preferable to be from 1:10 to 10:1.

Examples of polymers used in the present invention will be given below, it is, however, not limited to them. Compositions of copolymers are indicated by the weight ratio.

P-1: Poly (N-sec-butylacrylamide)
P-2: Poly (N-t-butylacrylamide)
P-3: Diacetoneacrylamide - methyl methacrylate copolymer (25:75)
P-4: Polycyclohexyl methacrylate
P-5: N-t-butylacrylamide - methyl methacrylate copolymer (60:40)
P-6: Poly (N,N-dimethylacrylamide)
P-7: Poly (t-butyl methacrylate)
P-8: Polyvinyl acetate
P-9: Polyvinyl propionate
P-10: Polymethyl methacryate
P-11: Polyethyl methacryate
P-12: Polyethyl acrylate
P-13: Vinyl acetate - vinyl alcohol copolymer (90:10)
P-14: Polybutyl acrylate
P-15: Polybutyl methacrylate
P-16: Polyisobutyl methacrylate
P-17: Polyisopropyl methacrylate
P-18: Polyoctyl acrylate
P-19: Butyl acrylate - acrylamide copolymer (95:5)
P-20: Stearyl methacrylate - acrylic acid copolymer (90:10)
P-21: Methyl methacrylate - vinyl chloride copolymer (70:30)
P-22: Methyl methacrylate - styrene copolymer (90:10)
P-23: Methyl methacrylate - ethyl acrylate copolymer (50:50)
P-24: Butyl methacrylate - methyl methacrylate - styrene copolymer (50:20:30)
P-25: Vinyl acetate- acrylamide copolymer (85;15)
P-26: Vinyl chloride - vinyl acetate copolymer (65:35)
P-27: Methyl methacrylate - acrylonitrile copolymer (65:35)

P-28: Butyl methacrylate - pentyl methacrylate -N-vinyl-2-pyrolidone copolymer (38:38:24)
P-29: Methyl methacrylate - butyl methacrylate - isobutyl methacrylate - acrylic acid copolymer (37:29:25:9)
P-30: Butyl methacrylate - acrylic acid copolymer (95:5)
P-31: Methyl methacrylate - acrylic acid copolymer (95:5)
P-32: Benzyl methacrylate - acrylic acid copolymer
P-33: Butyl methacrlate - methyl methacrylate - benzyl methacrylate - acrylic acid copolymer (35:35:25:5)
P-34: Butyl methacylate - methyl methacrylate - benzyl methacrylate copolymer (40:30:30)
P-35: Diacetonacrylamide - methyl methacrylate copolymer (50:50)
P-36: Methylvinylketone - isobutyl methacrylate copolymer (55:45)
P-37: Ethyl methacrylate - butyl acrylate copolymer (70:30)
P-38: Diacetoneacrylamide - butyl acrylate copolymer (60:40)
P-39: Methyl methacrylate - styrene methacrylatediacetoneacrylamide copolymer (40:40:20)
P-40: Butyl acrylate - styrene methacrylatediacetoneacrylamide copolymer (70:20:10)
P-41: Stearyl methacrylate - methyl methacrylate - acrylic acid copolymer (50:40:10)
P-42: Methyl methacrylate - styrene - vinyl sulfoneamide copolymer (70:20:10)
P-43: Methyl methacrylate - phenylvinylketone copolymer (70 30)
P-44: Butyl acrylate - methyl methacrylate - butyl methacrylate copolymer (35:35:30)
P-45: Butyl methacrylate N-vinyl-2-pyrolidone copolymer (90:10)
P-46: Polypentyl acrylate
P-47: Cyclohexyl methacrylate - methyl methacrylate - propyl methacrylate copolymer (37:29:34)
P-48: Polypentyl methacrylate
P-49: Methyl methacrylate - butyl methacrylate copolymer (65:35)
P-50: Vinyl acetate - vinyl propionate copolymer (75:25)
P-51: Butyl methacrylate - sodium 3-acryloxybutane-1-sufonate copolymer (97:3)
P-52: Butyl methacrylate - methyl methacrylate - acrylamide copolymer (35:35:30)
P-53: Butyl methacrylate - methyl methacrylate - vinyl chloride copolymer (37:36:27)
P-54: Butyl methacrylate - styrene copolymer (82:18)
P-55: T-butyl methacrylate - methyl methacrylate copolymer (70:30)
P-56: Poly(N-t-butylmethacrylamide)
P-57: N-t-butylacrylamide - methylphenyl methacrylate copolymer (60:40)
P-58: Methyl methacrylate - acrylonitrile copolymer (70:30)
P-59: Methyl methacrylate - methylvinylketone copolymer (38:72)
P-60: Methyl methacrylate - styrene copolymer (75:25)
P-61: Methyl methacrylate - hexyl methacrylate copolymer (70:30)
P-62: Butyl methacrylate - acrylic acid copolymer (85:15)
P-63: Methyl methacrylate - acrylic acid copolymer (80:20)
P-64: Methyl methacrylate - acrylic acid copolymer (90:10)
P-65: Methyl methacrylate - acrylic acid copolymer (98:2)
P-66: Methyl methacrylate - N-vinyl-2-pyrolidone copolymer (90:10)
P-67: Butyl methacrylate - vinyl chloride copolymer (90:10)
P-68: Butyl methycrylate - styrene copolymer (70:30)
P-69:1,4-butanediol - adipic acid polyester
P-70: Ethylene glycol - sebacic acid polyester
P-71: Polycaprolactam
P-72: Polypropiolactam
P-73: Polydimethylpropiolactone
P-74: N-t-butylacrylamide - dimethylaminoethylacrylamide copolymer (85:15)
P-75: N-t-butylmethacrylamide - vinylpyridine copolymer (95:5)
P-76: Diethyl maleate - butyl acrylate copolymer (65:35)
P-77: N-t-butylacrylamide - 2-methoxyethyl acrylate copolymer (55:45)
P-78: ω-methoxypolyethylene glycol methacrylate (number of ethylene glycol units n=6)- methyl methscrylate copolymer (40:60)
P-79: ω-methoxypolyethylene glycl acrylate (number of ethylene glycol units n=9)-N-t-butylacrylamide copolymer (25:75)
P-80: Poly(2-methoxyethyl acrylate)
P-81: Poly(2-methoxyethyl methacrylate)
P-82: Poly[2-(2-methoxyethoxy)ethyl acrylate]
P-83 2-(2-butoxyethoxy)ethyl acrylate - methyl methacrylate copolymer (58:42)
P-84: Poly(oxycarbonyloxy-1,4-phenyleneisobutylidene-1,4-phenylene)
P-85: Poly(oxyethyleneoxycarbonyliminohexamethyleneiminocarbonyl)
P-86: N-[4-(4'-hydroxyphenylsulfonyl)phenyl]acrylamide - butyl acrylate copolymer (65:35)
P-87: N-(4-hydroxyphenyl)methacrylamide - N-t-butylacrylamido copolymer (50:50)
P-88: [4-(4'-hydroxylphenylsulfonyl)phenoxymethyl]styrene (mixture of m and p compounds) - N-t-butylacrylamide copolymer (15:85)

A suspension containing oleophilic particles of the present invention can be prepared in the following manner: Dissolving the cyan coupler represented by Formula I, and the polymer compound which is not water-soluble but soluble to organic solvent in an organic solvent of Phthalic ester, having a dielectric point of not more than 6.0, and dispersing thus obtained solution in a hydrophilic binder such as gelatin solution with a dispersing means such as a agitator, homogenizer, colloid mill, flow jet mixer and supersonic apparatus.

A low-boiling organic solvent and/or water-soluble organic solvent can be used, according to the necessity, with the phthalic ester for dissolving the cyan coupler and the polymer compound. A surfactant is preferably used for dispersion.

It is also allowed that the organic solvent which has a low-boiling point and/or which is water-soluble is eliminated from the prepared dispersion by the distillation, noodle washing method or ultrafiltration method.

As low boiling organic solvents, ethyl acetate, butyl acetate, ethyl propionate, secondary butyl alcohol, methylethylketone, methylisobutylketone, β-ethoxyethyl acetate, methylcellosolve acetate and cyclohexanone can be cited. Besides, as water-soluble organic solvents, methyl alcohol, ethyl alcohol, aceton and tetrahydrofran can be cited. Not less than two kinds of these organic solvents can be used mixedly, if required.

Otherwise, it is also allowed to use the method described in Japanese Patent O.P.I. Publication No. 107642/1985 that polymers which are obtained from the monomer components of the above-mentioned homo or copolymer by a suspension polymerization, solution polymerization or block polymerization under the existence of the coupler, are dispersed in the hydrophilic binder in the above-mentioned manner.

Thus obtained suspension is added to a silver halide emulsion. The suspension may be further added in the other layer than the emulsion layer, if required.

To silver halide photographic light-sensitive materials of the present invention, an image stabilizer which prevents dye image deterioration can be used.

Image stabilizers preferably used in the light-sensitive material of the present invention are represented by the following Formulas III-1 and III-2.

Formula III-1

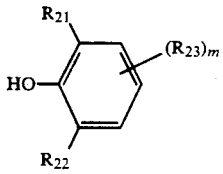

Wherein $R_{21}$ and $R_{22}$ each is an alkyl group. $R_{23}$ is an alkyl group, —NHR'23, —SR'23, in which R'23 is a monovalent organic group, or —COOR''23, in which R''23 is a hydrogen atom or a monovalent organic group, m is an integer of 0 to 3.

Formula III-2

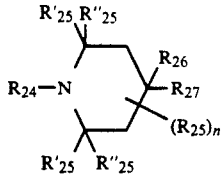

Wherein, $R_4$ is a hydrogen atom, a hydroxyl group, an oxyradical group, —SOR'24—SO2R'24, in which R'24 is an alkyl group or an aryl group, an alkyl group, an alkenyl group, an alkinyl group or —COR''24, in which R''24 is a hydrogen atom or a monovalent organic group. $R_{25}$, R'25 and R''25 each is an alkyl group. $R_{26}$ and $R_{27}$ each is a hydrogen atom or —OCOR'' in which R'' is monovalent organic group. Besides, a heterocyclic ring can be formed by cooperating of $R_{26}$ with $R_{27}$. n represents an ininteger of 0 to 4.

Hereunder, typical examples of the formula [III-1] and [III-2] will be illustrated. But it is not limited to them.

IIIa-1

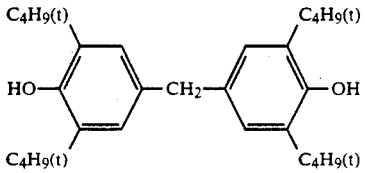

IIIa-2

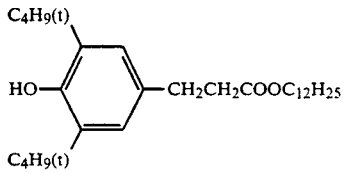

IIIa-3

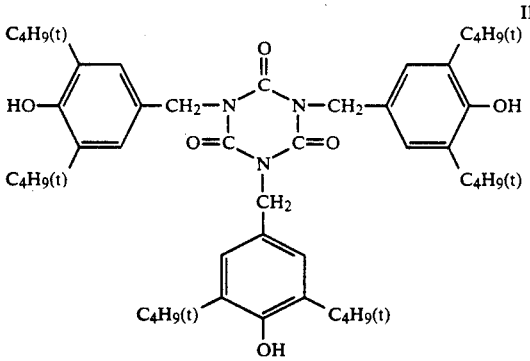

IIIa-4

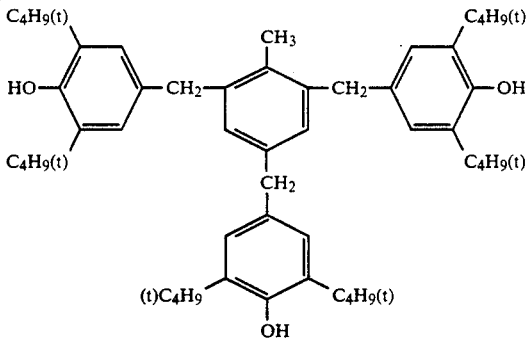

IIIa-5

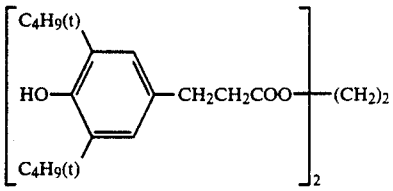

IIIa-6

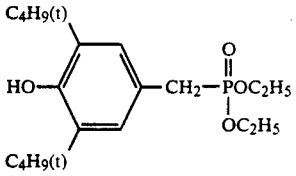

IIIa-7

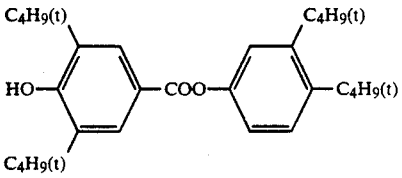

IIIa-8

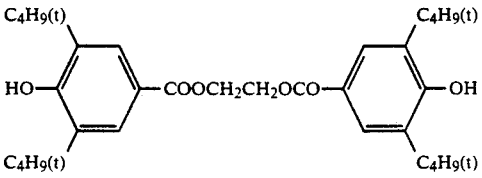

-continued
IIIa-9
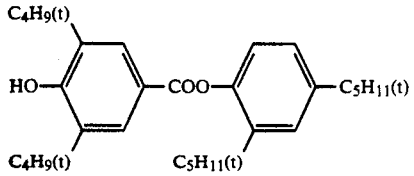
IIIa-10
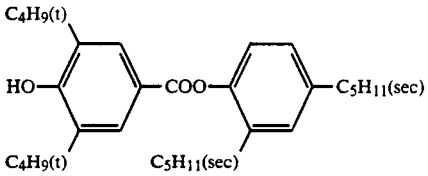
IIIa-11
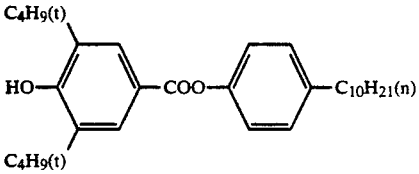
IIIb-1
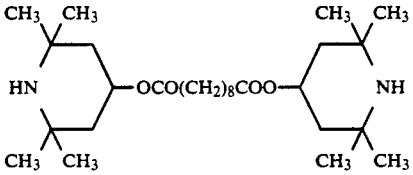
IIIb-2
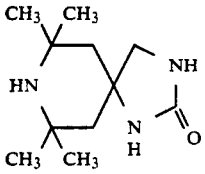
IIIb-3
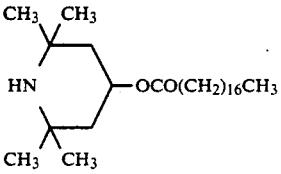
IIIb-4
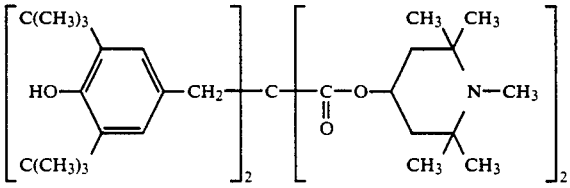
IIIb-5
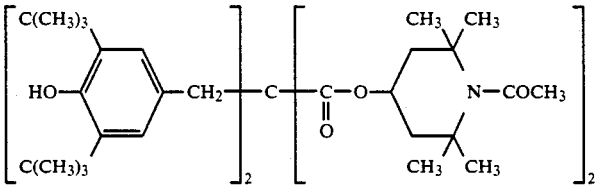
IIIb-6
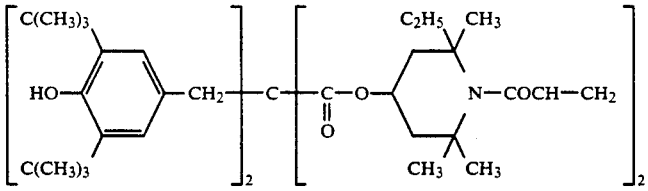
IIIb-7
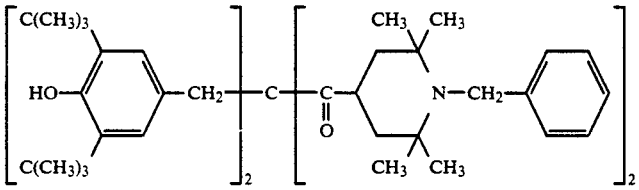
IIIb-8
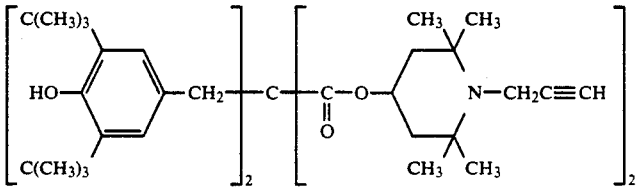

-continued

IIIb-9

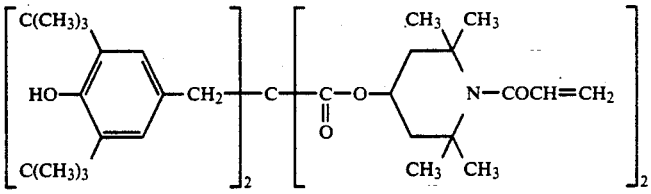

These image stabilizing compounds can be used independently or in combination. As an amount of adding to the cyan couplers of the present invention, 5 to 300 mol% is preferable, and 10 to 200 mol% is more preferable.

As silver halides used in the present invention, optional silver halides such as silver chloride, silver bromide, silver iodide, silver chlorobromide, silver iodobromide and silver chloroiodide may be used.

Silver halide grains preferably used in the present invention have the silver chloride content of not less than 90%, and it is preferable that silver bromide content is not more than 10 mol% and the silver iodide content is not more than 0.5 mol%. It is more preferable to be silver chlorobromide whose silver bromide content is 0.1 to 2 mol%.

The silver halide grain can be used independently or can be used in combination with other silver halide grains having different composition. Besides, it is allowed to be used in combination with silver halide grain whose silver chloride content is not more than 90%.

Besides, in ailver halide emulsion layer wherein silver halide grain having not less than 90 mol% of silver halide content, the ratio of silver halide grain having not less than 90 mol% of silver chloride content of the whole silver halide grain which is contained in the emulsion layer is not less than 60 weight %, preferably not less than 80 weight %.

Composition of silver halide grain may be uniform from the inside of the grain through the outside of it, or it may be different between the inside of the grain and the outside of it. Besides, in case that the composition of the inside is different from that of the outside, it may change either continuously or discontinuously.

There is no limitation to the grain size of silver halide grain, but when photographic properties such as rapid processing property and sensitivity are considered, the grain size is preferable to be 0.2 to 1.6 μm, more preferable to be 0.25 to 1.2 μm.

The above-mentioned grain size can be measured by various methods which are used in this field of technology widely. The typical method is described in "The Analysis Method of Grain Size" (A.S.T.M. Symposium on Light Microscopy, 1955, p 94–122.) or Chapter 2 of The Third Edition of "Theory of Photographic Process" by Meath and James, published by MacMillan Co.).

The grain size can be measured by the use of the projected area or the approximate diameter size of the grain. When the grain is substantially uniform, the grain size distribution can be represented considerably correctly as a diameter or a projected area.

The distribution of the grain size of silver halide grain can either be of a poly-dispersion type or of a mono-dispersion type. A mono-dispersion type silver halide grains are preferable, which have a variation coefficient in the grain size distribution of not more than 0.22, and more preferable not more than 0.15. Here, the variation coefficient is a coefficient to represent the width of grain distribution. It is defined by the following formula;

$$\text{Coefficient of variation } (S/\bar{r}) = \frac{\text{Standard deviation of grain size distribution}}{\text{Average grain size}}$$

$$\text{Standard deviation of grain size distribution } (s) = \sqrt{\frac{\Sigma(\bar{r} - ri)^2 ni}{\Sigma ni}}$$

$$\text{Average grain size } (\bar{r}) = \frac{\Sigma niri}{\Sigma ni}$$

Where, ri is a grain size of individual grain, ni is a number of the grains. In case that the silver halide grain is sphere, the grain size means its diameter. In case that the silver halide grain is cubic or one other than sphere, the grain size means a diameter of a circle equivalent in area to the actually-projected image of the silver halide grain.

In the present invention, silver halide grains of the emulsion may be obtained either by the acid method, the neutral method or the ammonical method. The grain can be grown by a shingle process, or it can be grown after a seed grain is made.

The method to make seed grains and the method to grow them may be the same or different.

As a method to react soluble silver salt and soluble halide salt, any of the normal precipitation method, the reverse precipitation method, the double-jet method and the method of combination thereof can be used. It is preferable to use the double-jet method. Besides, as a type of the double-jet method, pAg-controlled double jet method described in Japanese Patent O.P.I. Publication No. 48521/1979 can be used.

If it is further necessary, silver halide solvent such as thioether can be used. Such compounds as mercapto group containing compound, nitrogen-containing heterocyclic compound and sensitizing dye can be added, during or after silver halide grain is formed.

Any shape of a silver halide grain can be used for the present invention. Preferable one example is a cube having (100) surfaces as a crystal surface. It is possible to make grains having shapes of octahedron, tetradecahedron and dodecahedron, by methods described in U.S. Pat. Nos. 4,183,756 and 4,225,666, Japanese Patent O.P.I. Publication No. 26589/1980, Japanese Patent Examined Publication No. 42737/1980 and The Journal of Photographic Science (J.Photgr. Sci), 21, 39 (1973). It is also possible to use such grains having a twin plane.

Silver halide grain used in the present invention may be of either a mono-shaped grain type, or a mixed type wherein various shapes of grains are mixed.

In the silver halide emulsion used for the present invention, it is allowed to add to the silver halide grains a metal ion using such a salt as cadmium salt, zinc salt, pleadbum salt, thallium salt, iridium salt or its complex salt, rhodium salt or its complex salt or ferrite salt or its complex salt in the course of forming or growing the grains, so as the inside and/or the surface of the grains to contain it. Besides, by allowing the silver halide grains to be in a proper reducing atmosphere, reduction sensitizing nuclear can be formed in the inside and/or the surface of the grains.

Unnecessary soluble salts may be eliminated from the emulsion after the growth of the silver halide grains, or they may be kept in the emulsion. When eliminating the salts, it may be performed on the basis of the method described in Research Disclosure No. 17643.

In the present invention, silver halide grains of emulsion may either be that wherein latent image is formed on the surface thereof, or that wherein latent image is formed inside the grain. Preferable one is that wherein latent image is formed on the surface.

In the present invention, the emulsion is chemically sensitized by a conventional method; a sulfur sensitizing method using compounds containing sulfur which can react on silver ion or using active gelatins, a selenium sensitizing method using selenium compound, a reducing sensitizing method using reducing substance and a noble metal sensitizing method using gold or noble metal compound, may be used independently or in combination.

Emulsion can also be sensitized optically to the desired range of wavelength by using sensitizing dyes. As sensitizing dyes, cyanine dye, merocyanine dye, complex cyanine dye, complex merocyanine dye, holopolarcyanine dye, hemicyanine dye, styryl dye and hemioxyanole dye can be used.

Generally, dye forming couplers used for the silver halide photographic light-sensitive material of the invention are selected for each emulsion layer so that such dyes as those absorbing spectral region of light which is approximately the same as the spectral sensitive region of emulsion layer are formed in the emulsion layers; namely, yellow dye forming coupler is used for the blue sensitive emulsion layer, magenta dye forming coupler is used for the green sensitive emulsion layer, cyan dye forming coupler is used for the red sensitive emulsion layer. However, depending on the object, silver halide color photographic light-sensitive materials can be made by the combinations different from the above methods.

In the present invention, as a yellow dye forming coupler, acylacetoanylide type couplers may preferably be used. Among them, benzoylacetoanylide type compounds and pyvaroylacetoanylide type compounds are advantageous.

In the present invention, as a magenta coupler, known 5-pyrazoron type couplers and pyrazoroazole type couplers may be cited.

In light-sensitive materials of the present invention, the magenta coupler represented by the following formula [M-1] is preferably used.

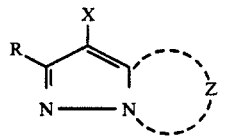

Formula [M-1]

In the formula, Z is a group of non-metal atoms necessary for forming nitrogen-containing heterocyclic ring which may have a substituent.

X is a hydrogen atom or a substituent which capable of splitting off upon reaction with the oxidied products of a color developing agent.

R is a hydrogen atom or a substituent.

There is no limit in particular to the substituent represented by R. Typically, an alkyl group, an aryl group, an anylino group, an acylamino group, a sulfonamido group, an alkylthio group, an arylthio group, an alkenyl group and a cycloalkyl group can be cited. In addition to them, a halogen atom and a cycloalkenyl group, an alkynyl group, a heterocyclic group, a sulfonyl group, a sulfinyl group, a phosphonyl group, an acyl group, a carbamoyl group, a sulfamoyl group, a cyano group, an alkoxy group, an aryloxy group, a heterocyclic-oxy group, a siloxy group, a acyloxy group, a carbomoyloxy group, an amino group, an alkylamino group, an imido group, a ureido group, a sulfamoylamino group, an alkoxycarbonylamino group, an aryloxycarbonylamino group, an alkoxycarbonyl group, an aryloxycarbonyl group, a thioheterocyclic-thio group, a spiro compound residual group and a bridged hydrocarbon compound residual group are given.

Those represented by formula M-1 are further represented by the following formulae M-II through M-VII.

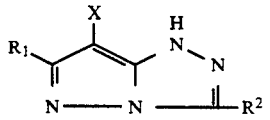

Formula M-II

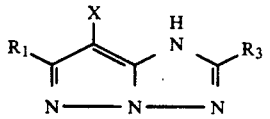

Formula M-III

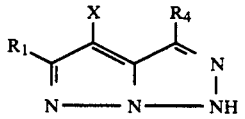

Formula M-IV

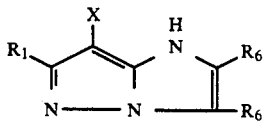

Formula M-V

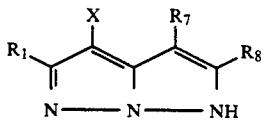

Formula M-VI

-continued

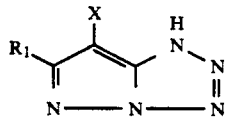

Formula M-VII

In the above-mentioned formula M-II through M-VII, $R_1$ through $R_8$ and X are the same as the above-mentioned R and X.

Among those represented by formula M-I, what is preferable is represented by the following formula M-VIII.

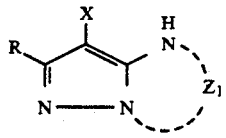

Formula M-VIII

In the formula, $R_1$, X and $Z_1$ are the same as R, X and Z in the formula M-I.

Among magenta couplers represented by the above-mentioned M-II through M-VII, what is particularly preferable is one represented by the formula M-II.

As substituent R and $R_1$ on the above-mentioned heterocyclic ring, most preferable one is what is represented by the following formula M-IX.

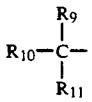

Formula M-IX

In the above formula, $R_9$, $R_{10}$ and $R_{11}$ are the same as the above-mentioned R in the meaning.

Two of the above-mentioned $R_9$, $R_{10}$ and $R_{11}$, for example $R_9$ and $R_{10}$, are allowed to be bound to form a saturated or unsaturated ring such as cycloalkane ring, cycloalken ring and heterocyclic ring. Besides, $R_{11}$ may be bound to the above-mentioned ring to constitute a bridged hydrocarbon group.

Among compounds represented by formula M-IX, what is preferable is the case (i) where at least two of $R_9$ through $R_{11}$ are alkyl group or the (ii) case where at least one of $R_9$ through $R_{11}$, for example $R_{11}$, is a hydrogen atom and the other two of $R_9$ and $R_{10}$ are bound to form cycloalkyl group with the carbon atoms represented by C in formula M-IX.

Among (i), what is preferable is the case where two of $R_9$ through $R_{11}$ are alkyl group and the other one is a hydrogen atom or an alkyl group.

As a substituent which may be owned by the ring represented by Z in the formula M-I and the ring represented by $Z_1$ in the formula M-VIII, and those represented by $R_2$ through $R_8$ in the formula M-II through M-VI, a group represented by the following formula M-X are preferable.

$$-R^1-SO_2-R^2$$

Formula M-X

In the formula, $R^1$ is an alkylene group, $R^2$ is an alkyl group, a cycloalkyl group or an aryl group.

An alkylene group represented by $R^1$ preferably has not less than two carbon atoms in the straight chain portion. The number of carbon atoms from three to six is more preferable and, wherein either a straight chain or a branched chain may be used.

As a cycloalkyl group represented by $R^2$, those having 5 or 6 members is preferable.

As actual examples of the compounds represented by the formula [M-I], M-1 through M-61 described on pages from the right bottom of page 5 to the left bottom of page 9 in Japanese Patent O.P.I. Publication No. 167360/1988 and the compounds No.1 through No.4, 6, 8 through 17, 19 through 24, 26 through 43, 45 through 59, 61 through 104, 106 through 121, 123 through 162, 164 through 223 among compounds described on pages from the right top of page 18 to the right top page 32 in Japanese Patent O.P.I. Publication No. 166339/1987 can be reterred.

The coupler is used in the range of $1\times10^{-3}$ mol to 1 mol, preferably, $1\times10^{-2}$ mol to $8\times10^{-1}$ mol per mol of silver halide.

To the silver halide emulsions of the present invention, an anti-foggant or a stabilizer can be added during chemical ripening, at the time of finishing the chemical ripening and/or in the period from finishing the chemical ripening to coating the emulsion, for the purpose of fog inhibiting or keeping the photographic properties stable on the stage of producing process, storage or photographic processing of light-sensitive material.

As the binder for the silver halide emulsion, it is preferable to use gelatin, but gelatin derivatives, graft polymers of gelatin and other polymers, other proteins, sugar derivatives, cellulose derivatives, hydrophilic colloids such as synthesized hydrophilic homo- or copolymers.

Light-sensitive material of the invention may contain, together with the color-forming coupler, such compounds as are capable of releasing a photographically useful fragments like development accelerator, bleaching accelerator, developing agent, silver-halide solvent, color toner, hardener, fogging agent, anti-foggant, chemical sensitizer, spectral sensitizer and desensitizer, by the coupling with the oxidized product of a color developing agent.

Further a colored coupler, DIR coupler or DIR compound can be used with the color-forming coupler. Such DIR couplers and DIR compounds include those having an inhibitor coupled directly to the coupling position of the coupler, timing DIR couplers and timing DIR compounds. With regard to the inhibitors, those having a difusibility and those having not so much difusibility after releasing may be used independently or compatibly according to the use. Non-dye forming coupler can also be used together with dye forming coupler.

To silver halide photographic light-sensitive material containing silver halide emulsion of the present invention, various photographic additives can be added other than the above-mentioned compounds.

For example, UV absorbing agent, development accelerator, surfactant, water-soluble anti-irradiation dye, physical property improver for photographic layer, anti-color staining agent, dye image stabilizer, water-soluble or oil-soluble fluorescent whitening agent and ground color adjustment agent.

Among dye forming coupler other than the cyan coupler of the invention, colored coupler, DIR coupler, DIR compound, image stabilizer; anti-color foggant, ultra-violet absorbing agent and fluorescent whitening agent, which are not necessary to be adsorbed onto the surface of silver-halide crystal, hydrophobic compounds can be added by using various methods such as the solid dispersion method, the latex dispersion method and the oil in water emulsifying dispersion method. The methods can be selected appropriately according to the chemical structures of hydrophobic compounds like couplers. As the oil in water type emulsifying dispersion method, various methods to disperse hydrophobic additives like couplers may be used. Generally, a high boiling organic solvent having a boiling point of not less than 150° C. and, according to the necessity low boiling point and/or water-soluble organic solvents are used compatibly to solve the additives. They are dispersed in a hydrophilic binder such as a gelatin solution with surfactant and with using such dispersion means as agitator, homogenizer, colloid mill, flow jet mixer and supersonic equipment. It is then added into an objective hydrophilic colloidal layer. It is allowed to insert a process to eliminate the low boiling organic solvent after or at the same time as the dispersion solution.

Color developing agents used in color developers for light-sensitivel material of the present invention include conventional ones which are used widely in various color phtographic processes. These developing agents also include, amino phenol derivatives and p-phenylene diamin derivatives. These compounds are used in the form of salt, for example, hydrochloride or sulfate because the salts are more stable than in free condition. These compounds are usually used in a concentration of 0.1 g to 30 g and, preferably, 1 g to 15 g, per 1 liter of color developer.

As amino phenol type developing agents, for example o-aminophenol, p-amino-phenol, 5-amino-2-hydroxytoluene, 2-amino-3-hydroxy-toluene, 2-hydroxy-3-amino-1,4-dimethylbenzene are used.

Particularly useful primary aromatic amin type color developing agents include N,N-dialkyl-p-phenylenediamine type compound. Alkyl and phenyl groups of the compound may be substituted by an optional substituent. Among them, most useful compounds includes, for example, N,N-diethyl-p-phenylenediamine hydrochloride, N-methyl-p-phenylenediamine hydrochloride, N,N-dimethyl-p-phenylenediamine hydrochloride, 2-amino-5-(N-ethyl-N-dodecylamino)toluene, N-ethyl-N-β-methanesulfonamidoetyl-3-methyl-4-aminoaniline sulfate, N-ethyl-N-β-hydroxyethylaminoaniline, 4-amino-3-methyl-N, N-diethylaniline and 4-amino-N-(2-methoxyethyl)-N-ethyl-3-methylaniline-p-toluenesulfonate.

To the color developers applicable to the developments of silver halide photographic light-sensitive materials of the present invention, conventional developer components can be added in addition to the above-mentioned aromatic primary amine type color developing agents. For example, alkalizers such as sodium hydroxide, sodium carbonate, and potassium carbonate, alkali metal sulfite, alkali metal bisulfite, alkali metal thiocyanate, alkali metal halides, benzyl alcohol, water-softener and thicker may be contained optionally.

It is preferable that the photographic light-sensitive material of the present invention is developed by a color developer which does not contain a water-soluble bromide compound at all or which contains it in an extremely small amount. When such water-soluble bromide compounds are excessively contained, there is a possibility to sharply decrease the development speed of the photographic light-sensitive material. Bromide ion concentration in the color developer is, in terms of potassium bromide, about not more than 0.1 g and preferably not more than 0.05 g per 1 liter of a color developer.

When a water-soluble chloride compound is used as a development agent in the above-mentioned color developer, the effect of the present invention becomes particularly remarkable. An amount of water-soluble chloride compound to be used is, in terms of potassium chloride, 0.5 g to 5 g and preferably 1 g to 3 g per 1 liter of a color developer.

The pH value of a color developer is ordinary not less than 7, most preferably 10 to 13.

The color developing temperature is ordinary not less than 15° C., preferably 20° C. to 50° C. For rapid developing, not less than 30° C. is preferable. The color developing time is preferable to be 20 seconds to 60 seconds and more preferable to be 30 to 50 seconds.

Silver halide photographic light-sensitive materials of the present invention may contain these color developing agents or in the form of thier precursors in the hydrophilic colloidal layer. The light sensitive materials can be developed in an alkaline activation bath. Color developing agent precursor is a compound capable of producing a color developing agent under an alkaline condition. They include Schiff base type precursors with an aromatic aldehyde derivative, polyvalent metal ion complex precursors, phthalimide derivative precursors, phosphoamide derivative precursors, sugar amine reactant precursors and urethane type precursors. The precursors of these aromatic primary amins color developers are disclosed in U.S. Pat. Nos. 3,342,599, 2,507,114, 2,695,234 and 3,719,492, U.K. Patent No. 803,783, Japanese Patent O.P.I. Publication Nos. 185628/1978 and 79035/1979, and Research Disclosure Nos. 15159, 12146 and 13924.

It is necessary for these aromatic primary amine color developing agents or their precursors to add a quantity as much as to get enough color density in this quantity only when they are activated. These quantities are considerably varied according to the kinds of light-sensitive materials. It is generally, however, in the range of 0.1 to 5 mols, and preferably 0.5 to 3 mols per mol of silver halide contained in the light-sensitive material. These color developing agents or their precursors can be used independently or in combination. In order to incorporate them into a light-sensitive material, they are dissolved into an appropriate solvent such as water, methanol, ethanol or aceton, and then added into a coating solution of the light-sensitive material. Besides, it is also possible to add them as a dispersion using a high boiling organic solvent such as dibutyl phthalate, dioctyl phthalate and tricresyl phosphate. It is also possible, as disclosed in The Research Disclosure No. 14850, to add them after being impregnated in a latex polymer.

The silver-halide photographic light-sensitive material of the present invention is treated in a bleaching process and a fixing process, after being color-developed. Both of bleaching and fixing processes can be done in the same process. As a bleaching agent, many compounds are used. Particularly, polyvalent metal compounds such as iron (III), cobalt (III) and copper (II), more particularly complex salts of a polyvalent metal cation and an organic acid such as aminopolycarbonic acids like ethylenediamine tetra acetic acid, nitrilotriacetic acid and N-hydroxyethylethylenediaminediacetic acid; metal complex salts of malonic acid, tartaric acid, malic acid, diglycol acid and dithioglycol acid; ferricyanates; and dichromates are used independently or in appropriate combination.

As a fixer, a soluble complex-forming agent, which makes silver halide soluble as a complex salt, is used. As the soluble complex-forming agents, sodium thiosulfato, ammonium thiosulfate, potassium thiocyanate, thiourea, and thioether are cited.

After the fixing process, normally, a washing process is applied. The washing process may be substituted by a stabilizing process. And both can also be used together. The stabilizers used in the stabilizing process may contain a pH adjusting agent, chelating agent and anti-mold. For the details of these practical conditions, refer to Japanese Patent O.P.I. Publication No. 134636/1983.

EXAMPLES

EXAMPLE-1

In the composition given in Table-1 and by the method described below, various coupler dispersions were made. The obtained dispersion was mixed with 500 g of a silver bromochloride emulsion having a silver bromide content of 80 mol%, which were spectrally red-sensitized. As a hardener, 10 ml of a 10% sodium 2,4-dihydroxy-6-chloro-s-triazine solution was added. The resulting emulsion was coated onto a polyethylene-coated paper support and dried, so that Samples 1 to 17 were obtained.

Preparation of the coupler dispersion solution

Cyan coupler that was 10 g of C-1 or a coupler given in Table-1 in an amount of equivalent in mols was disolved to a mixed solvent of 7 ml of dibutyl phthalate and 30 ml of ethyl acetate. This solution was added to 300 ml of an aqueous 5% gelatin solution containing sodium dodecylbenzene sulfonate. Then, it was dispersed by a supersonic homogenizer to make a coupler dispersion.

Thus obtained samples were each-exposed to light through an optical wedge by a conventional method. Then, the following processes were carried out.

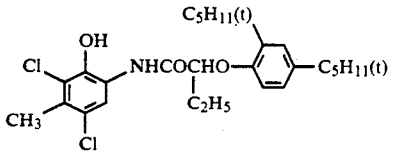

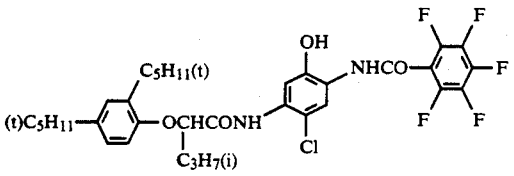

| [Processing step] | Temperature | Time |
|---|---|---|
| Color developing | 33° C. | 3 minutes 30 seconds |
| Bleach-fixing | 33° C. | 1 minute 30 seconds |
| Washing | 33° C. | 3 minutes |

| Color developer | |
|---|---|
| N-ethyl-N-β-methanesulfonamidoethyl-3-methyl-4-aminoaniline sulfate | 4.9 g |
| hydroxylamine sulfate | 2.0 g |
| potassium carbonate | 25.0 g |
| sodium bromide | 0.6 g |

-continued

| Color developer | |
|---|---|
| sodium sulfite anhydride | 2.0 g |
| benzyl alcohol | 13 ml |
| polyethylene glycol (average polymerization degree 400) | 3.0 ml |

Add water to make 1 liter, then adjust pH to be 10.0 by sodium hydroxide.

| Bleach-fixing solution | |
|---|---|
| ferric sodium ethylenediaminetetraacetate | 60 g |
| ammonium thiosulfate | 100 g |
| sodium bisulfite | 10 g |
| sodium methabisulfite | 3 g |

Add water to make 1 liter, and adjust pH to be 7.0 by aqueous ammonia.

With regard to the above-mentioned developed samples, the evaluation was done by the following method. The results are shown in Table-1.

Color forming property

Maximum reflection density (D max) of each processed sample was measured.

Light fastness

Each processed sample was covered with a ultra-violet absorbing filter and exposed to sun-light for 30 days by using an under glass out-door exposure stand, the light fastness thereof was indicated by the dye remaining ratio in the part where the initial density was 1.0.

Dark preservability

The sample was preserved in a test chamber for 21 days under the conditions at 85° C. and 60% relative humidity. In the same way as in the light fastness test, the dark preservability was indicated by the dye remaining ratio.

TABLE 1

| Sample No. | Cyan coupler | High boiling organic solvent | Polymer | Color developability | Light fastness | Dark preservability |
|---|---|---|---|---|---|---|
| 1 (Comp.) | C-1 | DBP | — | 1.73 | 71% | 38% |
| 2 (Comp.) | C-2 | DBP | — | 1.42 | 52 | 85 |
| 3 (Comp.) | I-4 | DBP | — | 1.67 | 65 | 67 |
| 4 (Comp.) | C-1 + C-2 | DBP | — | 1.62 | 59 | 68 |
| 5 (Comp.) | I-4 | TCP | — | 1.18 | 62 | 67 |
| 6 (Comp.) | I-4 | S-2 | — | 1.72 | 67 | 65 |
| 7 (Comp.) | I-4 | — | A-10 | 0.73 | 65 | 72 |
| 8 (Comp.) | I-4 | DBP | A-10 | 1.45 | 66 | 65 |
| 9 (Comp.) | I-4 | TCP | A-10 | 1.12 | 65 | 66 |
| 10 (Comp.) | I-4 | TNP | A-10 | 1.05 | 65 | 66 |
| 11 (Comp.) | C-1 | S-2 | A-10 | 1.61 | 71 | 47 |
| 12 (Inv.) | I-4 | S-2 | A-10 | 2.10 | 70 | 72 |
| 13 (Inv.) | I-4 | S-4 | A-10 | 2.15 | 72 | 75 |
| 14 (Inv.) | I-4 | S-2 | A-2 | 2.17 | 72 | 73 |
| 15 (Inv.) | I-4 | S-4 | A-2 | 2.16 | 73 | 75 |
| 16 (Inv.) | I-19 | S-2 | A-2 | 2.18 | 71 | 70 |
| 17 (Inv.) | I-19 | S-4 | A-2 | 2.20 | 73 | 73 |

DBP: dibutyl phthalate (Dielectric constant: 6.4)
TCP: tricresyl phosphate (Dielectric constant: 6.9)
TNP: trinonyl phosphate (Dielectric constant: 4.5)
Comp.: comparative sample
Inv.: inventive sample As is clear from Table-1, in Sample 1 which used coupler C-1 which was not the present invention, the color-forming property was insufficient and the dark preservability was also extremely deteriorated. In Samples 3 and 5 wherein the highly dielectric, high boiling organic solvents were applied to coupler I-4 relating to the invention, the color develo-forming property and the light fastness were insufficient, and the dark preservability was fairly deteriorated.

On the other hand, in Sample 2 used therein the dark coupler C-2 which has high dark preservability, the dark preservability was improved to a certain level, the color develo-forming property and the light fastness were deteriorated extremely. In Sample 4 in which two kinds of couplers were used compatibly, while it covered each deterioration point, all the characteristics were quite unsatisfactory. Even when using the high boiling organic solvent and the polymers relating to the present invention, such as in Samples 6 and 7, some partial improvement effects were obtained. However, the other characteristics were deteriorated.

Moreover, even when the polymers were combined with the high boiling organic solvents which are not the present invention, like Sample 8 through 10, the characteristics were not satisfactory in all cases. To the contrary, the characteristics were deteriorated more than in the case of the independent use. On the other hands, in Samples 12 through 17 which were the combination of the present invention, remarkable effects more than the compensation of their defects can be observed. These effects would not be predicted from the independent characteristics.

EXAMPLE-2

Each layer was coated by the compositions given in Table-2, so that a multilayered silver-halide color photographic light-sensitive material was prepared. Coating solutions of each layer were prepared by the same method as in Example 1. In the table, the amounts added are indicated by g/cm$^2$, and the amounts of silver halide emulsions are expressed in terms of the silver contents.

TABLE 2

| Layer | Composition | Added amount |
|---|---|---|
| The seventh layer (Protective layer) | Gelatin | 1.0 |
| The sixth layer (UV absorbing layer) | Gelatin | 0.6 |
| | UV absorbing agent UV-1 | 0.05 |
| | UV absorbing agent UV-2 | 0.2 |
| | UV absorbing agent UV-3 | 0.2 |
| | Stain preventing agent HQ-1 | 0.01 |
| | DBP | 0.2 |
| The fifth layer (Red-sensitive layer) | Gelatin | 1.4 |
| | Red-sensitive silver bromochloride emulsion (silver bromide is 80 mol %) | 0.24 |
| | Cyan coupler I-4 | 0.4 |
| | DBP | 0.3 |
| The fourth layer (UV absorbing layer) | Gelatin | 1.3 |
| | UV absorbing agent UV-1 | 0.1 |
| | UV absorbing agent UV-2 | 0.4 |
| | UV absorbing agent UV-3 | 0.4 |
| | Stain preventing agent HQ-1 | 0.03 |
| | DBP | 0.4 |
| The third layer (Green-sensitive layer) | Gelatin | 1.4 |
| | Green-sensitive silver chlorobromide emulsion (silver bromide 80 mol %) | 0.31 |
| | Magenta coupler M-1 | 0.35 |
| | Dye image stabilizer ST-1 | 0.23 |
| | Dye image stabilizer ST-2 | 0.09 |
| | DBP | 0.23 |
| The second layer (Intermediate layer) | Gelatin | 1.2 |
| | Stain preventing agent HQ-1 | 0.12 |
| | DBP | 0.15 |
| The first layer (Blue-sensitive layer) | Gelatin | 1.3 |
| | Blue-sensitive silver bromochloride emulsion (silver bromide 80 mol %) | 0.30 |
| | Yellow coupler Y-1 | 0.80 |
| | DBP | 0.20 |
| Support | polyethylene laminated paper | |

Y-1

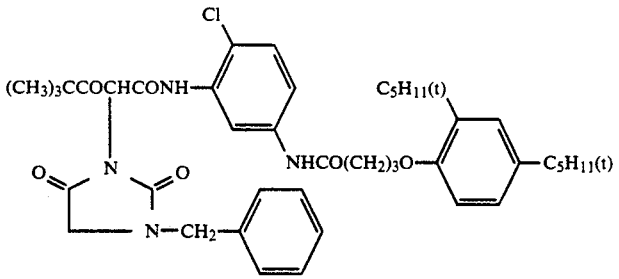

M-1

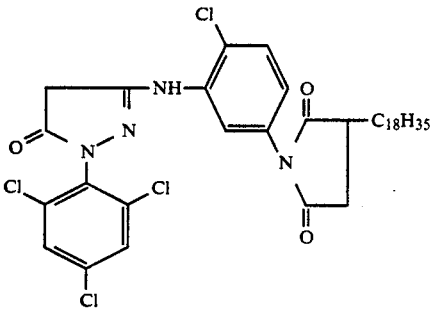

UV-1

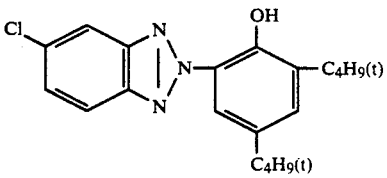

-continued

UV-2

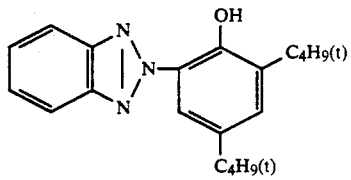

UV-3

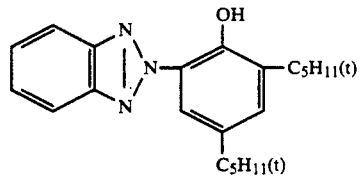

HQ-1

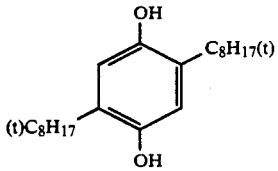

ST-1

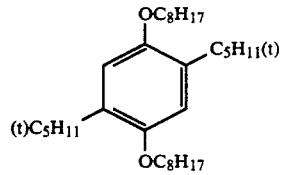

ST-2

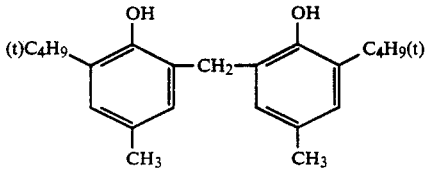

The obtained sample is referred to as 18.

Then, each emulsion, the cyan coupler in the fifth layer, the high boiling organic solvent and the magenta coupler in the third layer, each of Sample 18 were replaced by those shown in Table-3, so that Samples 19 through 47 were prepared.

However, when the magenta coupler was replaced by M-2 or M-3, the dye image stabilizer in the third layer was changed to the following ST-3 and ST-4, respectively and the amount of silver coated was also changed to be 0.21 g/m$^2$.

M-2

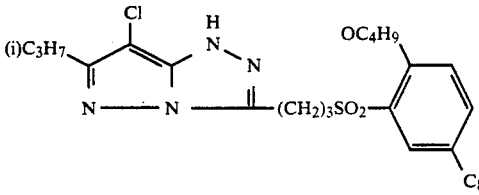

M-3

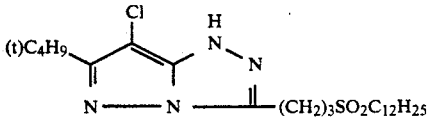

ST-3

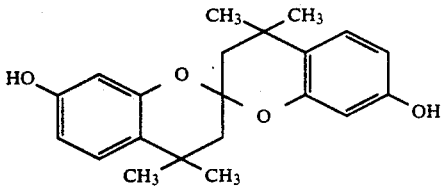

ST-4

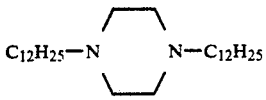

Each sample was exposed and developed. The results of the same evaluation as example 1 are shown in Table-3.

In the evaluation, the light fastness of cyan and magent images and the dark preservability of cyan image were measured.

With regard to the development process, the processes numbered in Table-3 were applied.

| Developing process A | | |
|---|---|---|
| Same as in Example 1. | | |
| **Developing process B** | | |
| | Temperature | Time |
| Color developing | 35.0 ± 0.3° C. | 45 seconds |
| Bleaching and fixing | 35.0 ± 0.5° C. | 45 seconds |
| stabilizing | 30~34° C. | 90 seconds |
| Drying | 60~80° C. | 60 seconds |

| Color developer | |
|---|---|
| Pure water | 800 ml |
| triethanolamine | 10 g |
| N,N-diethylhydroxylamine | 5 g |
| Potassium bromide | 0.02 g |
| Potassium chloride | 2 g |
| Potassium sulfite | 0.3 g |
| 1-hydroxyethylidene-1,1-diphosphoric acid | 1.0 g |
| Ethylenediaminetetraacetic acid | 1.0 g |
| Disodium catecol-3,5-disulfonate | 1.0 g |
| N-ethyl-N-β-methanesulfonamidoethyl-3-methyl-4-aminoanilene sulfate | 4.5 g |
| Fluorescent whitener (4,4'-diaminostylbene-disulfonic acid derivative) | 1.0 g |
| Potassium carbonate | 27 g |

Add water to make 1 liter in total and adjust pH to be 10.10 with potassium hydroxide or sulfuric acid.

| Bleach-fixer | |
|---|---|
| Ferric ammonium ethylenediaminetetraacetate dihydride | 60 g |
| Ethylenediamintetraaceticacid | 3 g |
| Ammonium thiosulfate 70% aqueous solution | 100 ml |
| Ammonium sulfite 40% aqueous solution | 27.5 ml |

| Stabilizer | |
|---|---|
| 5-chloro-2-methyl-4-isothiazoline-3-one | 1.0 g |
| ethylene glycol | 1.0 g |
| 1-hydroxyethylidene-1,1-diphosphoric acid | 2.0 g |
| Ethylenediaminetetraacetic acid | 1.0 g |

-continued

| Stabilizer | |
|---|---|
| Ammonium hydroxide 20% aqueous solution | 3.0 g |
| Ammonium sulfite | 3.0 g |
| Fluorescent whitener (4,4'-diaminostylbenedisulfonic acid derivative) | 1.5 g |

Add water to make 1 liter, and adjust pH to be 7.0 with sulfuric acid or potassium hydroxide.

TABLE 3

| Sample No. | Cyan Coupler | High boiling point organic solvent | Polymer | Magenta Coupler | Emulsion (AgBr Mol %) | Developing Process | Color-forming Property | Light fastness Cyan | Light fastness Magenta | Dark Preservability (cyan) |
|---|---|---|---|---|---|---|---|---|---|---|
| 18 (Comp.) | I-4 | DBP | — | M-1 | 80 | A | 1.97 | 65% | 77% | 62% |
| 19 (Comp.) | I-4 | — | P-10 | M-1 | 80 | A | 1.09 | 68 | 77 | 67 |
| 20 (Comp.) | I-4 | DBP | P-10 | M-1 | 80 | A | 1.77 | 65 | 76 | 65 |
| 21 (Inv.) | I-4 | S-2 | P-10 | M-1 | 80 | A | 2.37 | 72 | 76 | 75 |
| 22 (Inv.) | I-4 | S-4 | P-10 | M-1 | 80 | A | 2.41 | 73 | 76 | 77 |
| 23 (Inv.) | I-4 | S-7 | P-10 | M-1 | 80 | A | 2.42 | 73 | 76 | 79 |
| 24 (Inv.) | I-4 | S-2 | P-2 | M-1 | 80 | A | 2.39 | 79 | 76 | 76 |
| 25 (Inv.) | I-4 | S-4 | P-2 | M-1 | 80 | A | 2.45 | 79 | 75 | 79 |
| 26 (Inv.) | I-10 | S-2 | P-2 | M-1 | 80 | A | 2.40 | 72 | 75 | 75 |
| 27 (Inv.) | I-19 | S-2 | P-2 | M-1 | 80 | A | 2.37 | 71 | 75 | 76 |
| 28 (Inv.) | I-4 | S-2 | P-2 | M-2 | 80 | A | 2.40 | 78 | 78 | 75 |
| 29 (Inv.) | I-4 | S-2 | P-2 | M-3 | 80 | A | 2.41 | 78 | 80 | 76 |
| 30 (Comp.) | I-4 | DBP | — | M-1 | 1 | B | 1.77 | 64 | 75 | 61 |
| 31 (Comp.) | I-4 | — | P-10 | M-1 | 1 | B | 0.86 | 65 | 74 | 63 |
| 32 (Comp.) | I-4 | DBP | P-10 | M-1 | 1 | B | 1.21 | 65 | 74 | 63 |
| 33 (Inv.) | I-4 | S-2 | P-10 | M-1 | 1 | B | 2.35 | 75 | 74 | 77 |
| 34 (Inv.) | I-4 | S-4 | P-10 | M-1 | 1 | B | 2.39 | 78 | 74 | 77 |
| 35 (Inv.) | I-4 | S-2 | P-2 | M-1 | 1 | B | 2.42 | 81 | 75 | 78 |
| 36 (Inv.) | I-4 | S-4 | P-2 | M-1 | 1 | B | 2.44 | 82 | 75 | 79 |
| 37 (Inv.) | I-10 | S-2 | P-2 | M-1 | 1 | B | 2.39 | 76 | 74 | 77 |
| 38 (Inv.) | I-19 | S-2 | P-2 | M-1 | 1 | B | 2.38 | 75 | 74 | 78 |
| 39 (Inv.) | I-4 | S-2 | P-10 | M-2 | 1 | B | 2.36 | 76 | 77 | 78 |
| 40 (Inv.) | I-4 | S-4 | P-10 | M-2 | 1 | B | 2.39 | 78 | 78 | 78 |
| 41 (Inv.) | I-4 | S-2 | P-2 | M-3 | 1 | B | 2.43 | 82 | 80 | 78 |
| 42 (Inv.) | I-4 | S-4 | P-2 | M-3 | 1 | B | 2.43 | 84 | 81 | 79 |

As is clear from Table-3, considerable effects were displayed only in the case of the combination of the present invention. It is clear that the color-forming property and the image preservability have been improved.

In the case of Samples 33 through 42 each comprising the highly silver chloride containing emulsions and processed by rapied processing B, the color-forming property which deteriorated remarkably in comparative Samples 30 through 32 have attained a normal level having almost no problem in the inventive samples 33 to 42.

In the case of Samples 28, 29 and 39 through 42, in each of which the magenta couplers represented by formula M-I, the color balance has become uniform even in color fading. Therefore, it is found out that they are good color photographic light-sensitive materials.

Besides, with regard to Samples wherein the polymer of Sample 36 of the present invention was replaced by A-5, A-22, A-77 and A-80, respectively the effects of the present invention could still be obtained.

EXAMPLE-3

Preparation of silver halide emulsion

Six kinds of silver halide emulsions shown in Table-4 were prepared by the neutral double-jet method.

TABLE 4

| Emulsion No. | AgCl % | AgBr % | Average grain size (μm) | Chemical sensitizer | Spectral sensitizing dye |
|---|---|---|---|---|---|
| Em-1 | 10 | 90 | 0.67 | sodium | SD-1*3 |
| Em-2 | 30 | 70 | 0.46 | thiosulfate*1 | SD-2*4 |
| Em-3 | 30 | 70 | 0.43 | | SD-3*5 |
| Em-4 | 99.5 | 0.5 | 0.67 | sodium | SD-1*3 |
| Em-5 | 99.5 | 0.5 | 0.46 | thiosulfate*1 | SD-2*4 |
| Em-6 | 99.5 | 0.5 | 0.43 | chloroauric acid*2 | SD-3*5 |

*1Adding 2 mg per mol of silver halide
*2Adding $1 \times 10^{-5}$ mol per mol of silver halide
*3Adding 0.9 milli mol per mol of silver halide
*4Adding 0.7 milli mol per mol of silver halide
*5Adding 0.2 milli mol per mol of silver halide To each silver halide emulsion, St-1 which is shown below was added at the rate of $2\times10^{-4}$ mol per mol of silver halide as a stabilizer after finishing of chemical sensitizing.

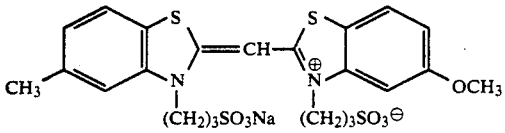

SD-2

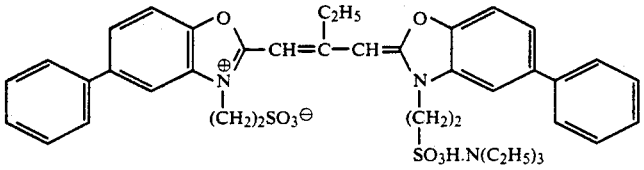

SD-3

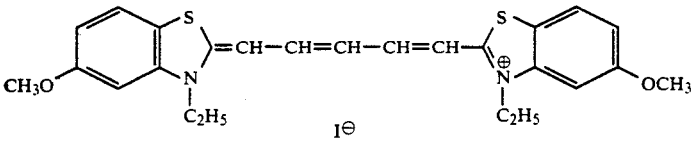

St-1

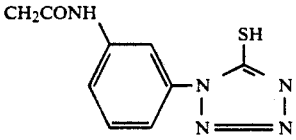

Preparation of multi-layer silver halide color photographic light-sensitive material.

A paper support was used, which was laminated by polyethylene layer on one surface and by polyethylene layer containing titanium oxide was on the the other surface. Onto the surface of the support laminated by the tilanium oxide-containg layer, layers having composition shown in Table-5 were coated so that 11 kinds of multi-layer silver-halide color photographic light-sensitive materials were prepared. The coating solution was prepared as follows:

The fifth layer coating solution 60 ml of ethyl acetate was added to 29.2 milli mol of cyan coupler shown in Table-6, 22.1 g of polymer compound shown in Table-6, 8.3 g of dye image stabilizer (AO-1), 0.42 g of stain preventing agent (HQ-1) and 12.5 g of high boiling point organic solvent (DOP) to be solved. This solution was poured into 200 ml of 10% gelatin aqueous solution containing 10 ml of 10% sodium alkylnaphthalene sulfonate to be dispersed with a homogenizer so that a cyan coupler dispersion was prepared.

The dispersion was mixed with the red-sensitive silver chlorobromide emulsion Em-3, containing 10 g silver halide in terms of silver and the gelatin solution for coating so that the coating solution for the fifth layer was prepared.

The solutions of the other layers were prepared in the same way as that for the above-mentioned coating solution for the fifth layer.

As a coating aid, the following SF-1 and SF-2 were used. As a hardener of gelatin, the following H-1 was used.

SF-1

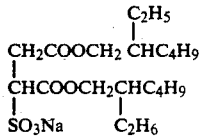

SD-1

SF-2

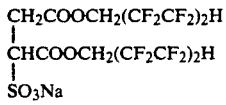

H-1

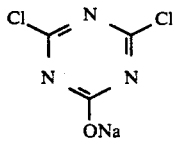

TABLE 5

| Layer | Composition | Added amount |
|---|---|---|
| The seventh layer (protective layer) | Gelatin | 1.0 |
| The sixth layer (Ultra violet absorbing layer) | Gelatin | 0.6 |
| | Ultra violet absorber UV-3 | 0.2 |
| | Ultra violet absorber UV-2 | 0.2 |

TABLE 5-continued

| Layer | Composition | Added amount |
|---|---|---|
| | Strain preventing agent HQ-1 | 0.01 |
| | Exemplified solvent S-5 | 0.2 |
| The fifth layer (Red-sensitive layer) | Gelatin | 1.40 |
| | Red-sensitive silver halide emulsion Em-3 in silver equivalent | 0.24 |
| | Cyan coupler (described in Table 3) | 0.7* |
| | Polymer compound (described in Table 3) | 0.53 |
| | Dye image stabilizer ST-5 | 0.20 |
| | Stain preventing agent HQ-1 | 0.01 |
| | Exemplified solvent S-3 | 0.30 |
| The fourth layer | Gelatin | 1.30 |
| (Ultra violet absorbing layer) | Ultra violet absorber UV-3 | 0.40 |
| | Ultra violet absorber UV-2 | 0.40 |
| | Stain preventing agent HQ-1 | 0.03 |
| | Exemplified solvent S-5 | 0.40 |
| The third layer (Green-sensitive layer) | Gelatin | 1.40 |
| | Green-sensitive silver halide emulsion Em-2 in silver equivalent | 0.21 |
| | Magenta coupler M-3 | 0.35 |
| | Dye image stabilizer ST-3 | 0.20 |
| | Dye image stabilizer ST-4 | 0.10 |
| | Stain preventing agent HQ-1 | 0.01 |
| | DOP | 0.30 |
| The second layer (Intermediate layer) | Gelatin | 1.20 |
| | Stain preventing agent HQ-1 | 0.12 |
| | Exemplified solvent S-7 | 0.15 |
| The first layer (Blue-sensitive layer) | Gelatin | 1.30 |
| | Blue-sensitive silver halide emulsion Em-1 in silver equivalent | 0.30 |
| | Yellow coupler Y-1 | 0.80 |
| | Dye image stabilizer ST-5 | 0.30 |
| | Stain preventing agent HQ-1 | 0.02 |
| | Exemplified solvent S-5 | 0.40 |
| Support | polyethylene laminated paper | |

An added amount is indicated by g/m$^2$, and "*" is milli mol/m$^2$.

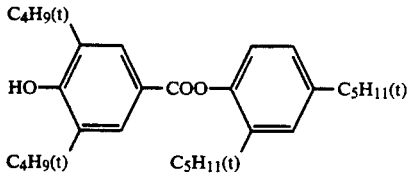

AO-1

Obtained samples were exposed to red light through an optical wedge by using the sensitometer KS-7 (manufactured by KONICA CORPORATION), and they were processed in the same manner as Example-1. Then, by using densitometer (Type PDA-65 manufactured by KONICA), the maximum density (D max) of the red sensitive emulsion layer was measured by red light.

Spectral absorption of cyan image in each sample which has a density of 1.0 at the maximum sobsorption wavelength, was measured and the maximum absorption wavelength λ max, the density at green region $D_G$ and the density at blue region $D_B$ were determined. Lower values of $O_G$ and $D_B$ correspond to higher color purity of cyan image.

Obtained samples were preserved for 20 days under the condition of 85° C. and 60% RH, and the residual rate (%) of the dye image in the portion where the initial density measured by red light was 1.0 was obtained, thus the dark fading property was estimated. The results are shown in Table-6.

TABLE 6

| Sample No. | Cyan coupler in the first layer (moll ratio) | Polymer compound in the first layer | Dmax | λmax (nm) | $D_B$ | $D_G$ | Preservability of cyan image (%) | Note |
|---|---|---|---|---|---|---|---|---|
| 101 | I-4 | — | 2.54 | 655 | 0.459 | 0.478 | 69 | Comp. |
| 102 | II-2 | — | 1.96 | 649 | 0.374 | 0.528 | 97 | Comp. |
| 103 | I-4, II-2 (1:1) | — | 2.36 | 652 | 0.405 | 0.498 | 84 | Comp. |
| 104 | I-4 | P-2 | 2.41 | 655 | 0.455 | 0.455 | 83 | Inv. |
| 105 | II-2 | P-2 | 1.54 | 649 | 0.370 | 0.510 | 99 | Comp. |
| 106 | I-4, II-2 (1:1) | P-2 | 2.24 | 652 | 0.398 | 0.474 | 93 | Inv. |
| 107 | I-15, II-5 (1:1) | P-2 | 2.38 | 651 | 0.404 | 0.474 | 90 | Inv. |
| 108 | I-20, II-7 (1:1) | P-2 | 2.21 | 652 | 0.401 | 0.470 | 94 | Inv. |
| 109 | I-19, II-24 (1:1) | P-2 | 2.27 | 650 | 0.403 | 0.478 | 92 | Inv. |
| 110 | I-4, II-23 (1:2) | P-2 | 2.28 | 650 | 0.391 | 0.489 | 96 | Inv. |
| 111 | I-4, II-21 (2:1) | P-2 | 2.31 | 653 | 0.422 | 0.467 | 89 | Inv. |

As is clear from Table-6, the samples 101 and 104 in which cyan coupler represented by the formula I is used independently have a defect that $D_B$ is high. Besides, by using the polymer compound in the present invention, the dark conservability is improved. But it is not satisfactory. Samples 102 and 105 wherein cyan coupler represented by the above-mentioned formula II is used independently are excellent in dark conservability, but $D_G$ is high and $D_{max}$ is low, which is not preferable. Sample 103 which uses cyan couplers represented by the above-mentioned formulas [I] and [II] in combination without polymer compound is relatively good, but $D_G$ is still high and the dark conservability is not enough. On the other hand, the samples 106 through 111 which use cyan couplers represented by formulas [I] and [II] and also use the polymer compound of the invention are low in $D_B$ and $D_G$ and excellent in color reproducibility, values and further, their dark conservability are improved and $D_{max}$ values are high, which means that, they are excellent samples.

EXAMPLE-4

Multi-layer silver halide color photographic light-sensitive materials, Samples 201 through 212 were prepared in the same way as in Example-3 except that the blue sensitive silver chlorobromide emulsion Em-1 for the first layer, the green sensitive silver chlorobromide emulsion Em-2 for the third layer and the red sensitive silver chlorobromide emulsion Em-3 for the fifth layer all in Example-3 were changed to Em-4, Em-5 and Em-6 respectively and the cyan couplers and polymer compounds for the fifth layer were changed to those shown in Table-7.

Obtained samples were exposed to ligh in the same way as that in Example-3, and processed in the same manner as Processing B in Example 2. Then, they were evaluated, similarly to Example-3. The results are shown in Table-7.

TABLE 7

| Sample No. | Cyan coupler in the first layer (moll ratio) | Polymer compound in the first layer | Dmax | λmax (nm) | $D_B$ | $D_G$ | Preservability of cyan image (%) | Note |
|---|---|---|---|---|---|---|---|---|
| 201 | I-4 | — | 2.40 | 655 | 0.448 | 0.461 | 68 | Comp. |
| 202 | II-2 | — | 1.86 | 649 | 0.370 | 0.512 | 98 | Comp. |
| 203 | I-4, II-2 (1:1) | — | 2.22 | 652 | 0.401 | 0.488 | 83 | Comp. |
| 204 | I-4 | P-2 | 2.31 | 655 | 0.444 | 0.450 | 84 | Inv. |
| 205 | II-2 | P-2 | 1.48 | 649 | 0.367 | 0.492 | 99 | Comp. |
| 206 | I-4, II-2 (1:1) | P-2 | 2.10 | 652 | 0.396 | 0.468 | 93 | Inv. |
| 207 | I-2, II-3 (1:1) | P-2 | 2.26 | 652 | 0.392 | 0.466 | 92 | Inv. |
| 208 | I-7, II-17 (1:1) | P-2 | 2.14 | 651 | 0.399 | 0.471 | 94 | Inv. |
| 209 | I-15, II-18 (1:1) | P-5 | 2.12 | 652 | 0.401 | 0.465 | 91 | Inv. |
| 210 | I-19, II-24 (1:1) | P-5 | 2.08 | 651 | 0.397 | 0.473 | 94 | Inv. |
| 211 | I-20, II-24 (1:1) | P-22 | 2.06 | 650 | 0.402 | 0.470 | 93 | Inv. |
| 212 | I-17, II-20 (2:1) | P-22 | 2.25 | 653 | 0.411 | 0.460 | 90 | Inv. |

As is clear from Table-7, Samples 201 and 204 in which cyan coupler represented by formula I is used independently have relatively high $D_B$. Value by using the polymer compounds of the invention, however, the dark conservability is improved. Samples 202 and 205 in which cyan coupler represented by formula II is used independently are excellent in dark conservability but $D_G$ is high and $D_{max}$ is low, which is not preferable. Sample 203 which uses in combination the cyan couplers represented by formulas 1 and 11 without polymer compound of the present invention is wholly improvel in the properties, but $D_G$ is still high and dark conservability is not enough. On the other hand, samples from 206 through 212 using cyan couplers represented by formulas I and II in combination and the polymer compound of the present invention are lowered in $D_B$ and $D_G$ and excellent in color reproducibility, and further excellent in dark conservability and $D_{max}$.

Besides, in comparison with Example-3, it is understood that in the present examples in which light-sensitive materials employing silver halide grains having a high silver chloride content are processed through the rapid processing using the developer containing no benzylalcohol, lowered $D_B$ and $D_G$ values, particularly lowered $D_G$ valuse are obtained, which are preferable in color reproducibility.

Further, with regard to the samples in which cyan coupler I-4 of the sample 206 was replaced by I-6 and I-12, cyan coupler II-2 was replaced by II-8, II-13 and II-25 and polymer compound P-2 was replaced by P-77, P-10 and P-80, the effect of the present invention was verified.

EXAMPLE-5

Sample 301 was prepared in the same manner as that in Example-4 except that magenta coupler in the third layer of Sample 206 was changed to the foregoing magent coupler M-1 and the added amount of the green sensitive silver chlorobromide in the third layer was changed to 0.31 g/m$^2$ in terns of silver.

Then, a the KONICA Color GX 100 was used for photographing a Color Checker (manufactured by Macbethh Co., Ltd.) and processed. The obtained negative image was printed on the above-mentioned samples 206 and 301 for the evaluation of color reproducibility. Printing conditions were controlled so that a correct neutral gray image was reproduced on each sample.

As a result, it turned out that Sample 206 was better in the reproductions of blue, red and magenta colors.

EXAMPLE-6

A silver nitrate aqueous solution and a potassium bromide aqueous solution, both are the same in terms of a mol, were added to a gelatin solution simultaneously for 50 minutes at 50° C. by the double-jet method to prepare an emulsion composed of cubic silver bromide grains having an average grain size of 0.15μm. To this emulsion, a silver nitrate solution and a sodium chloride potassium bromide mixed solution (mol ratio was 1:1) were further added simultaneously to prepare cubic core/shell type emulsion EMP-1 composed of silver bromide core and silver chlorobromide shell having an average grain size of 0.225μm.

In addition to the above-mentioned emulsion, coore/-shell type emulsions shown in the following Table-8 were prepared by changing the adding time of a silver nitrate solution and a halide solution.

TABLE 8

| Emulsion No. | core grain size | whole grain size |
|---|---|---|
| EMP-1 | 0.150 μm | 0.225 μm |
| EMP-2 | 0.181 μm | 0.272 μm |
| EMP-3 | 0.293 μm | 0.440 μm |
| EMP-4 | 0.550 μm | 0.750 μm |

Using obtained emulsion EMP 1 ~4, samples 401 to 406 were made as follows.

On a paper support polyethylene laminated or both surfaces, the first layer through the eighth layer were coated as shown in Table-9. As a coating aid, SF-1 and SF-2 were used, and as a hardener, H-1 and H-2 were used.

TABLE 9

| Layer | Composition | Added amount |
|---|---|---|
| The eighth layer (Ultra violet absorbing layer) | Ultraviolet absorbing agent UV-3 | 0.65 |
| | Ultraviolet absorbing agent UV-2 | 1.95 |
| | Exemplified solvent S-6 | 1.0 |
| | Colloidal silica | 0.07 |
| | Gelatin | 7.8 |
| The seventh layer (Blue-sensitive layer) | Emulsion EMP-3 | 4.4* |
| | Emulsion EMP-4 | 1.2* |
| | Blue sensitive sensitizing dye BD-1 | |
| | Yellow coupler Y-1 | 8.2 |
| | Dye image stabilizer ST-5 | 3.0 |
| | Stain preventing agent HQ-1 | 0.25 |
| | Stain preventing agent HQ-2 | 0.25 |
| | Solvent DBP | 5.2 |
| | Inhibitor St-1, St-2, St-4, St-5, St-6 | |
| | Gelatin | 14.3 |
| The sixth layer | Stain preventing agent HQ-1 | 0.55 |

TABLE 9-continued

| Layer | Composition | Added amount |
|---|---|---|
| (Intermediate layer) | Exemplified solvent S-3 | 0.72 |
| | Gelatin | 5.4 |
| The fifth layer (colloidal silver layer) | Yellow colloidal silver | 1.05 |
| | stain preventing agent | 0.40 |
| | Exemplified solvent S-3 | 0.49 |
| | Polyvinylpyrolidone | 0.47 |
| | Gelatine | 9.2 |
| The fourth layer (Intermediate layer) | Stain preventing agent HQ-1 | 0.55 |
| | Exemplified solvent S-3 | 0.72 |
| | Gelatin | 5.4 |
| The third layer (Green-sensitive layer) | Emulsion EMP-2 | 1.30* |
| | Emulsion EMP-3 | 2.0* |
| | Green-sensitive sensitizing dye GD-1 | |
| | Magenta coupler M-2 | 2.4 |
| | Dye image stabilizer ST-5 | 2.2 |
| | Dye image stabilizer ST-3 | 1.25 |
| | Stain preventing agent HQ-1 | 0.03 |
| | Stain preventing agent HQ-2 | 0.19 |
| | Exemplified solvent S-7 | 3.15 |
| | Inhibitor St-1, St-2, St-3, St-4, St-5, St-6 | |
| | Gelatin | 13.0 |

TABLE 9-continued

| Layer | Composition | Added amount |
|---|---|---|
| The second layer (Intermediate layer) | Stain preventing agent HQ-1 | 0.55 |
| | Exemplified solvent S-3 | 0.72 |
| | Gelatin | 7.5 |
| The first layer (Red-sensitive layer) | Emulsion EMP-1 | 0.5* |
| | Emulsion EMP-2 | 0.7* |
| | Emulsion EMP-3 | 2.08* |
| | Red-sensitive sensitizing dye RD-1 | |
| | Red-sensitive sensitizing dye RD-2 | |
| | Cyan coupler (illustrated in Table 7) | $8 \times 10^{-6}$** |
| | Polymer compound (illustrated in Table 7) | 4.0 |
| | Dye image stabilizer ST-5 | 2.2 |
| | Stain preventing agent HQ-2 | 0.15 |
| | Exemplified solvent S-3 | 3.3 |
| | Inhibitor St-1, St-2, St-3, St-4, St-5, St-6 | |
| | Gelatin | 13.8 |
| Support | Polyethylene laminated paper (140 μm) | |
| Back layer | Colloidal silica | 6.0 |
| | Gelatin | 5.3 |

Coating weight is indicated by mg/dm$^2$.
The "*" mark represents a value in silver equivalent, and "**" is mol/dm$^2$.

RD-1

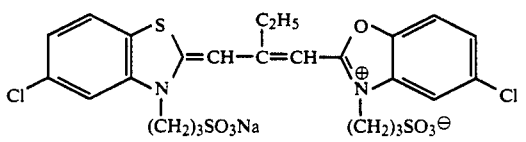

RD-2

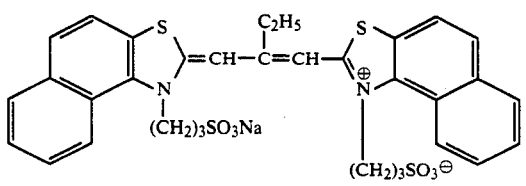

GD-1

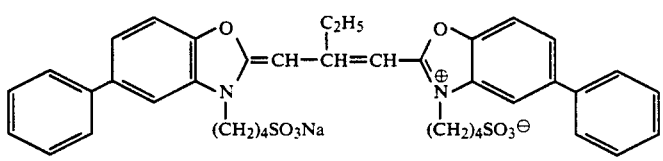

BD-1

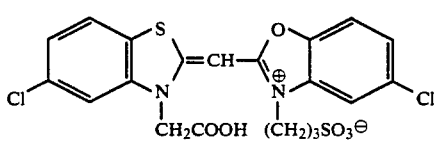

HQ-2

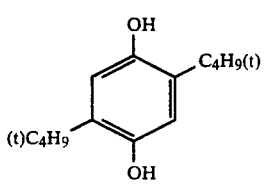

ST-6

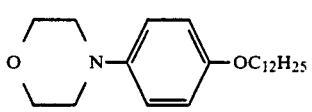

-continued

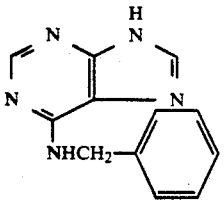

St-2

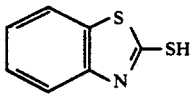

St-3

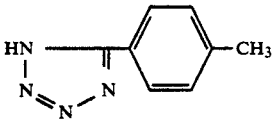

St-4

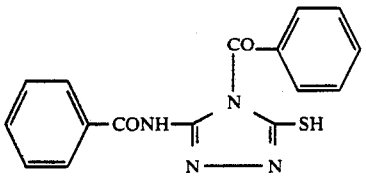

St-5

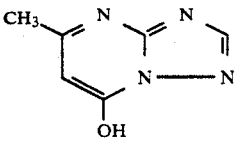

St-6

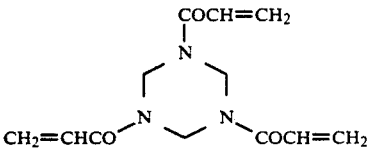

H-2

Obtained samples were subjected to exposured in the same way as in Example-3. After processing according to the following steps, λ max, $D_B$, $D_G$ and dark conservability were evaluated in the same manner as in Example 3. Obtained results are shown in Table-10.

| Processing steps (Processing temperature and time) | | |
|---|---|---|
| (1) Immersion in color developer | 38° C. | 8 seconds |
| (2) Fogging exposure | — | 10 seconds in 1 lux |
| (3) Color developing | 38° C. | 2 minutes |
| (4) Bleach-fixing | 35° C. | 60 seconds |
| (5) stabilizing | 25~30° C. | 1 minutes and 30 seconds |
| (6) Drying | 75~80° C. | 1 minutes |

| Color developer | |
|---|---|
| Benzyl alcohol | 10 ml |
| Ethylene glycol | 15 ml |
| Potassium sulfite | 2.0 g |
| Potassium bromide | 1.5 g |
| Sodium chloride | 0.2 g |
| Potassium carbonate | 30.0 g |
| hydroxylamine sulfate | 3.0 g |
| Polyphosphoric acid (TPPS) | 2.5 g |
| N-ethyl-N-β-methanesulfonamidoethyl-3-methyl-4-aminoanilene sulfate | 5.0 g |

-continued

| Color developer | |
|---|---|
| Fluorescent whitening agent (4,4'-diaminostylbenzysulfonic acid derivative) | 1.0 g |
| Potassium hydroxide | 2.0 g |

Add water to make 1 liter in total, and adjust to pH 10.20.

| Bleach-fixer | |
|---|---|
| Ferric ammonium ethylenediaminetetraacetate dihydride | 60 g |
| Ethylenediaminetetraacetic acid | 3 g |
| Ammonium thiosulfate (70% solution) | 100 ml |
| Ammonium sulfite (40% solution) | 27.5 ml |

Add water to make 1 liter, and adjust to pH=7.1 with potassium carbonate or glacial acetic acid.

| Stabilizer | |
|---|---|
| 5-chloro-2-methyl-4-isothiazoline-3-on | 1.0 g |
| Ethylene glycol | 10 g |
| 1-hydroxyethylidene-1,1-diphosphonic acid | 2.5 g |
| Bismuth chloride | 0.2 g |
| Magnesium chloride | 0.1 g |

-continued

| Stabilizer | |
|---|---|
| Ammonium hydroxide (28% solution) | 2.0 g |
| Sodium nitrilotriacetate | 1.0 g |

Add water to make 1 liter in total, adjust to pH=7.0 with ammonium hydroxide or sulfuric acid.

Stabilizing process was performed by two bath counter-current system.

TABLE 10

| Sample No. | Cyan coupler in the first layer (moll ratio) | Polymer compound in the first layer | λmax (nm) | $D_B$ | $D_G$ | Preservability of cyan image (%) | Note |
|---|---|---|---|---|---|---|---|
| 401 | I-4 | — | 656 | 0.462 | 0.480 | 71 | Comp. |
| 402 | II-2 | — | 649 | 0.384 | 0.528 | 98 | Comp. |
| 403 | I-4, II-2 (1:1) | — | 652 | 0.410 | 0.500 | 85 | Comp. |
| 404 | I-4 | P-2 | 655 | 0.454 | 0.463 | 84 | Inv. |
| 405 | II-2 | P-2 | 649 | 0.377 | 0.516 | 99 | Comp. |
| 406 | I-4, II-2 (1:1) | P-2 | 652 | 0.398 | 0.481 | 93 | Inv. |

As is clear from Table-10, only Sample 406 in the present invention using cyan coupler represented by Formula I, cyan coupler represented by Formula II and polymer compounds of the present invention is small in $D_B$ and $D_G$ and thereby excellent also in dark preservability too.

What is claimed is:

1. A silver halide photographic light-sensitive material comprising a support having thereon a silver halide emulsion layer containing oleophilic dispersed particles comprising a cyan coupler represented by the following Formula I, a high-boiling organic solvent represented by the following Formula S, and a polymer compound being insoluble in water and soluble in an organic solvent:

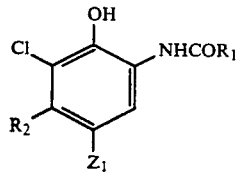

(I)

wherein $R_1$ is a ballast group, $R_2$ is an alkyl group having 2 or more carbon atoms and $Z_1$ is a hydrogen atom or a substituent capable of splitting off upon reaction with the oxidation product of a color developing agent;

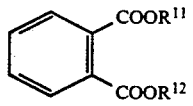

(S)

wherein $R^{11}$ and $R^{12}$ are each an alkyl group, an alkenyl group or an aryl group provided that the total number of carbon atoms contained in said groups represented by $R^{11}$ and $R^{12}$ is 12 to 32.

2. The material of claim 1, wherein said alkyl group represented by $R_2$ is an alkyl group having 2 to 6 carbon atoms, which is allowed to have a substituent.

3. The material of claim 1, wherein said ballast group is a group represented by the following Formula I-B:

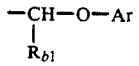

(I-B)

wherein $R_{B1}$ is an alkyl group having 1 to 12 carbon atoms and Ar is an aryl group which is allowed to have a substituent.

4. The material of claim 1, said oleophilic particles further contain a cyan coupler represented by the following Formula II:

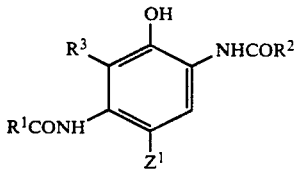

(II)

wherein $R^1$ is an alkyl group or an aryl group, $R^2$ is an alkyl group, a cycloalkyl group, an aryl group or a heterocyclic group, $R^3$ is a hydrogen atom, a halogen atom, an alkyl group or an alkoxy group, provided that the group represented by $R^3$ is allowed to form a ring together with the group represented by $R^1$, $Z^1$ is a hydrogen atom or a substituent capable of splitting off upon reaction with the oxidation product of a color developing agent.

5. The material of claim 4, wherein said alkyl group represented by $R^1$ is an alkyl group having 1 to 32 carbon atoms which is allowed to have a substituent.

6. The material of claim 4, wherein said aryl group represented by $R^1$ is a phenyl group which is allowed to have a substituent.

7. The material of claim 4, wherein said cyan coupler represented by Formula II is a coupler represented by the following Formula II-A:

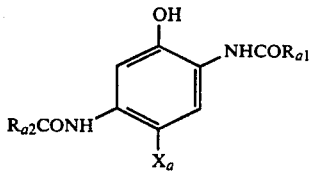

(II-A)

wherein $R_{A1}$ is a phenyl group having at least one halogen atom, which is allowed to have further substituent other than the halogen atom, $R_{A2}$ is the same as $R^1$ defined in Formula II, and $X_A$ is a halogen atom, an aryloxy group or an alkoxy group, which is allowed to have a substituent.

8. The material of claim 1, wherein said organic solvent has a dielectric point within the range of from 1.9 to 5.0.

9. The material of claim 1, wherein said total number of carbon atoms is 18 to 24.

10. The material of claim 1, wherein said polymer compound has a number-average molecular weight of not more than 200,000.

11. The material of claim 10, wherein said polymer compound has a number-average molecular weight of from 5,000 to 100,000.

12. The material of claim 1, wherein, said polymer compound is a homo-polymer or a co-polymer comprising a vinyl monomer.

13. The material of claim 1, wherein said polymer compound is a polyester resin produced by condensation of a polyhydric alcohol and a polybasic acid.

14. The material of claim 1, wherein said polymer compound is a polyester resin produced by ring-opening polymerization.

15. The material of claim 1, wherein ratio by weight of said polymer compound to said coupler is within the range of from 16. The material of claim 15, wherein ratio by weight of said polymer compound to said coupler is within the range of from 1:10 to 10:1.

17. The material of claim 1, wherein said silver emulsion layer comprises silver halide grains comprising not less than 90 mol% of silver chloride.

18. The material of claim 17, wherein said silver halide grains comprises silver chlorobromide having a silver bromide content of from 0.1 to 2 mol%.

* * * * *